US005644640A

United States Patent [19]

Fosgate

[11] Patent Number: 5,644,640

[45] **Date of Patent: *Jul. 1, 1997**

[54] SURROUND SOUND PROCESSOR WITH IMPROVED CONTROL VOLTAGE GENERATOR

[75] Inventor: James W. Fosgate, Heber City, Utah

[73] Assignee: Harman International Industries, Inc., Northridge, Calif.

[ * ] Notice: The term of this patent shall not extend beyond the expiration date of Pat. No. 5,504,819.

[21] Appl. No.: 624,907

[22] Filed: Mar. 27, 1996

Related U.S. Application Data

[63] Continuation of Ser. No. 276,901, Jul. 18, 1994, Pat. No. 5,504,819, which is a continuation-in-part of Ser. No. 990,660, Dec. 14, 1992, Pat. No. 5,428,687, which is a continuation-in-part of Ser. No. 533,091, Jun. 8, 1990, Pat. No. 5,172,415.

[51] Int. Cl.[6] ..... H04R 5/00

[52] U.S. Cl. ..... 381/18; 381/22

[58] Field of Search ..... 381/18, 17, 19, 381/20, 21, 22, 23

[56] References Cited

U.S. PATENT DOCUMENTS 5,172,415 12/1992 Fosgate ..... 381/22
5,263,087 11/1993 Fosgate ..... 381/22
5,428,687 6/1995 Fosgate ..... 381/18
5,504,819 4/1996 Fosgate ..... 381/18

*Primary Examiner*—Minsun Oh
*Attorney, Agent, or Firm*—Haynes and Boone, L.L.P.

[57] ABSTRACT

A surround sound processor for presenting stereophonic audio signals on a number of loudspeakers surrounding a listening area, comprising an input matrix stage, a detector filter and matrix circuit, a direction detector circuit incorporating improved filters, a novel detector splitter circuit providing three direction signals from the two direction detector circuit outputs, a novel three-channel servologic circuit with improved variable filters responding selectively to the rates of change of the direction signals and providing six control voltage signals through linearity correction networks to six voltage-controlled amplifiers, the outputs of which are combined in an output matrix to provide a number of loudspeaker feed signals through buffer amplifiers to the output terminals of the processor. The detector splitter circuit is configurable to either a forward oriented or a backward oriented mode of operation, corresponding changes being made to the voltage-controlled amplifiers and output matrix circuitry. Additionally the detector splitter may be switched to eliminate the third direction signal with corresponding changes to the output matrix circuitry.

3 Claims, 12 Drawing Sheets

SURROUND SOUND PROCESSOR WITH IMPROVED CONTROL VOLTAGE GENERATOR

CROSS REFERENCE TO RELATED APPLICATION

This application is a continuation of U.S. patent application Ser. No. 08/276,901, filed Jul. 18, 1994, which now U.S. Pat. No. 5,504,819 is a continuation-in-part of patent application Ser. No. 07/990,660, filed Dec. 14, 1992, now U.S. Pat. No. 5,428,687 entitled "Control Voltage Generator Multiplier and One-Shot For Integrated Surround Processor, which is a continuation-in-part of U.S. Pat. No. 5,172,415, issued on Dec. 15, 1992 from U.S. patent application Ser. No. 07/533,091, filed Jun. 8, 1990.

TECHNICAL FIELD

The present invention relates in general to processors for the periphonic reproduction of sound. More specifically, the invention relates to improvements in the servologic control voltage generator of a surround sound processor for multichannel redistribution of audio signals.

BACKGROUND OF THE INVENTION

This invention relates to improvements in a surround sound processor. A surround sound processor operates to enhance a two-channel stereophonic source signal so as to drive a multiplicity of loudspeakers arranged to surround the listener, in a manner to provide a high-definition soundfield directly comparable to discrete multitrack sources in perceived performance. An illusion of space may thus be created enabling the listener to experience the fullness, directional quality and aural dimension or "spaciousness" of the original sound environment. The foregoing so-called periphonic reproduction of sound can be distinguished from the operation of conventional soundfield processors which rely on digitally generated time delay of audio signals to simulate reverberation or "ambience" associated with live sound events. These conventional systems do not directionally localize sounds based on information from the original performance space and the resulting reverberation characteristics are noticeably artificial.

To accomplish this end, a surround sound processor typically comprises an input matrix, a control voltage generator and a variable matrix circuit. The input matrix usually provides for balance and level control of the input signals, generates normal and inverted polarity versions of the input signals, plus sum and difference signals, and in some cases generates phase-shifted versions, and/or filters the signals into multiple frequency ranges as needed by the remainder of the processing requirements.

The control voltage generator includes a directional detector and a servologic circuit. The directional detector measures the correlations between the signals which represent sounds encoded at different directions in the stereophonic sound stage, generating voltages corresponding to the predominant sound directional location. The servologic circuit uses these signals to develop control voltages for varying the gain of voltage controlled amplifiers in the variable matrix circuit in accordance with the sound direction and the direction in which it is intended to reproduce the sound in the surrounding loudspeakers.

The variable matrix circuit includes voltage-controlled amplifiers and a separation matrix. The voltage-controlled amplifiers amplify the input matrix audio signals with variable gain, for application to the separation matrix, where they are used to selectively cancel crosstalk into different loudspeaker feed signals. The separation matrix combines the outputs of the input matrix and of the voltage-controlled amplifiers in several different ways, each resulting in a loudspeaker feed signal, for a loudspeaker to be positioned in one of several different locations surrounding the listener. In each of these signals, certain signal components may be dynamically eliminated by the action of the detector, control voltage generator, voltage-controlled amplifiers (VCA's) and separation matrix.

In surround sound processors, much of the subtleties of the presentation are due to the characteristics of the direction detector and servologic circuit of the control voltage generator and of the VCA's. As these are further refined, the apparent performance becomes more transparent and effortless-sounding to the listener.

SUMMARY OF THE INVENTION

The present invention provides an improved surround processor for the reproduction of sound from a stereophonic source in a manner comparable to a live presentation from multiple sources in perceived performances. The present invention relates in particular to improvements in the implementation of the circuitry of a servologic control voltage generator, employing multiple-axis control voltage signals.

In a departure from the art, the processor includes a direction detector circuit incorporating improved filters, a detector splitter circuit providing three direction signals from the two direction detector circuit outputs, and a three-channel servologic circuit with improved variable filters responding selectively to the rates of change of the direction signals and providing six control voltage signals, through linearity correction networks, to six voltage-controlled amplifiers, the outputs of which are combined in an output matrix to provide a number of loudspeaker feed signals through buffer amplifiers to the output terminals of the processor. The detector splitter circuit is configurable to either a forward oriented or a backward oriented mode of operation, corresponding changes being made to the voltage-controlled amplifiers and output matrix circuitry. Additionally the detector splitter may be switched to eliminate the third direction signal with corresponding changes to the output matrix circuitry.

In a preferred embodiment, a surround sound processor is provided for receiving left and right audio signals of a stereophonic source and for processing the left and right signals for presentation on a plurality of loudspeakers surrounding a listening area so as to produce an impression of discrete sound sources surrounding a listener therein. The processor includes a pair of input terminals for receiving left and right audio signals; an input matrix circuit which receives the left and right audio signals from the pair of input terminals and comprises at least an inverting amplifier and a non-inverting amplifier of equal gain for each channel to provide the left and right audio signals in either polarity to succeeding circuits; a detector filter which receives the left and right audio signals from the input matrix circuit and filters each of them with a suitable transfer characteristic to provide left and right filtered signals; a detector matrix circuit which receives and combines the left and right filtered signals to provide their sum and difference as additional front and back filtered signals respectively; a direction detector circuit which receives the left and right filtered signals and processes them to provide a left-right direction signal proportional to the logarithm of the ratio of the amplitude of the right filtered signal to that of the left filtered signal, up to a limiting voltage, and which also receives the front and back filtered signals and processes them to provide a front-back direction signal proportional to the logarithm of the ratio of the amplitude of the back filtered signal to the front filtered signal, up to the same limiting voltage; a detector splitter circuit which receives the left-right and front-back direction signals and processes them to provide one or more additional direction signals While modifying the left-right and front-back direction signals to maintain constancy of the sum of all the said direction signals; a servologic circuit which receives the modified left-right and front-back direction signals and the one or more additional direction signals from the detector splitter circuit, filters each of them with a variable low-pass filter, inverts each resulting signal and half-wave rectifies each signal and its inversion to provide a plurality of smoothly varying control voltage signals of the same polarity; a plurality of voltage-controlled amplifiers equal to the plurality of the control voltage signals, a different one of the control voltage signals being connected to control the gain of each of the voltage-controlled amplifier, each of the plurality of voltage-controlled amplifiers receiving different proportions of the left or right signals or their inversions from the input matrix circuit, and summing the received signals with a variable gain dependent upon the corresponding one of said plurality of control voltage signals applied thereto; an output matrix circuit comprising a plurality of matrix circuits equal to said plurality of loudspeakers, each matrix circuit receiving one or more of the left and right signals and their inversions from the input matrix circuit and one or more output signals from said plurality of voltage-controlled amplifiers, and combining them in suitable proportions to obtain a loudspeaker feed signal wherein unwanted directional components are canceled; a plurality of output terminals equal to the plurality of loudspeakers; and a plurality of output buffers equal to the plurality of loudspeakers, each output buffer receiving one of the plurality of loudspeaker feed signals from the output matrix circuit and amplifying it to an appropriate level for driving a power amplifier connected to one said output terminal of the processor, for driving the corresponding one of said plurality of loudspeakers surrounding said listening area.

An advantage achieved with the invention is that the surround processor provides faster but smoother and more realistic multichannel sound redistribution from a stereophonic source.

DETAILED DESCRIPTION OF THE INVENTION

The principal new features of the present invention are the inclusion of a detector splitter circuit, permitting six different control voltage signals to be developed, each of which corresponds to a different sound direction in the surround sound field, and the provision of two different modes of operation in the detector splitter circuit and the VCA's of the variable matrix circuit.

To understand these more fully, the preferred embodiments of the invention will be described in detail below. However, the principles on which the present invention are based will first be reviewed.

Figure 1:
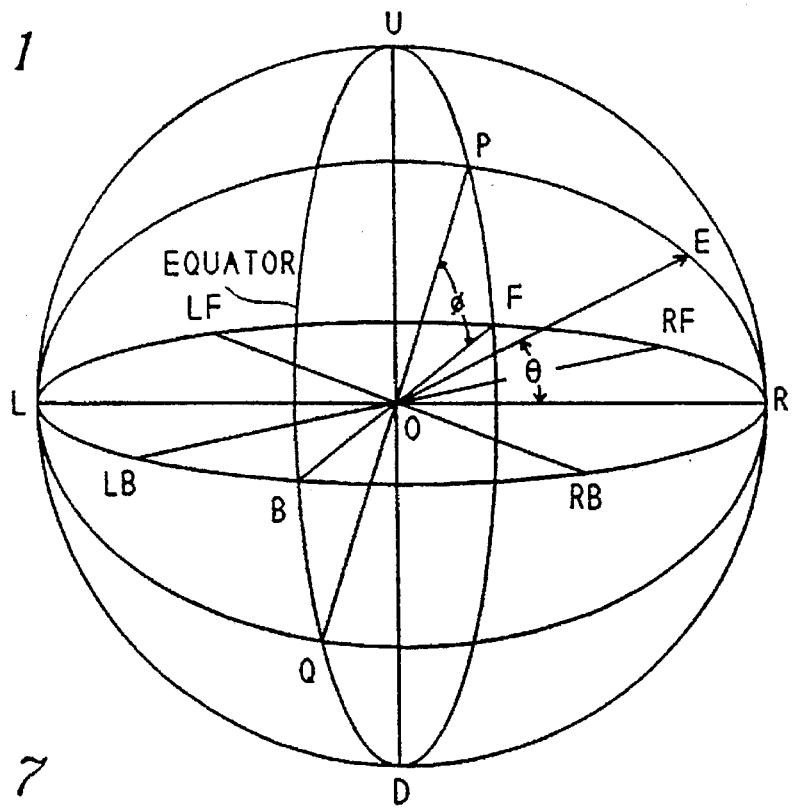
FIG. 1 is a diagrammatic representation of an energy sphere.

In FIG. 1 is shown a conventional representation of the amplitude and phase relationships between the left and right channels of a stereophonic signal pair, called the Scheiber sphere (after Peter Scheiber) or energy sphere (this term is due to M. A. Gerzon), which relates the relative amplitudes, or amplitude ratio, of the left and right channels to an angle $\Theta$ and the phase angle between the signals to another angle $\phi$. These correspond to spherical polar coordinates of a sphere in which the polar axis runs from left to right in the horizontal plane, and the "longitude" represents the ratio between right and left signals, while the "latitude" represents the phase angle. Specifically, for sinusoidal signals l, r, of any frequency, and having amplitudes L, R respectively, $$R/L=\tan((\Theta/2)) \quad (1)$$

and r lags l by the phase angle $\phi$. Thus the pair of signals l and r of frequency f can be represented by sinusoidal components:

$$l=E\cos((\Theta/2)\cos(wt) \quad (2)$$

$$r=E\sin((\Theta/2)\cos(wt-\phi) \quad (3)$$

where $L=E\cos((\Theta/2)$, $R=E\sin((\Theta/2)$, and $w=2\pi f$.

In FIG. 1, this signal is represented by the vector OE, which lies on the plane LPRQ and makes an angle of $\Theta$ with the axis OR. The plane LPRQ intersects the equatorial plane FUBD in the line PQ passing through the center O of the sphere, which makes an angle $\phi$ with the horizontal plane LFRB.

It can be shown that the locus of the unit vectors of all possible values of $\phi$ and $\Theta$ is a sphere, having a polar coordinate system described by the coordinates $((\Theta, \phi)$, with one pole at the left or L point and one at the right or R point. A conventional view of this sphere is one having the left pole at the left, the right pole at the right, and all in-phase or antiphase vectors lying in a horizontal plane through the L and R poles. The line joining these poles is the left-right (or L-R) axis.

Conventionally, as in FIG. 1, this sphere is viewed from a point above the horizontal plane, in the antiphase half, and to the right of center, so that all three primary axes of the sphere, L-R, B-F and D-U are seen in correspondence with the conventional z, x, and y Cartesian axes respectively, since the polar axis, usually called z, is horizontal in this figure. The equatorial circle of this sphere, FUBD, which is the locus of all vectors which have equal left and right signal amplitudes as the phase difference $\phi$ between them varies, is in a vertical plane and the viewpoint is to the right of this plane. The equatorial plane intersects the horizontal plane LFRB in a line which is termed the front-back (or F-B) axis.

Consider a stereophonic center front signal in which the left and right amplitudes are equal and the signals are in phase. The location of this signal on the Scheiber sphere is F, on the equator midway between the L and R poles, and is also in the horizontal plane, conventionally drawn away from the viewing direction at the "front" or F location on the sphere. The "back" or B location is diametrically opposite this "front" location, F, so that the front-back or F-B axis, the line joining these two points, is orthogonal to the left-right or L-R axis. This back location represents a signal pair in which L and R signals are equal in amplitude but of opposite polarity, i.e. in antiphase, or 180° out of phase.

In some multichannel signal processors, the third orthogonal axis extends from a point on the sphere directly below its center, the "down" point, D, to the corresponding point directly above the sphere, or "up" point, U, thus forming a third orthogonal axis called the up-down or U-D axis. The "up" point represents a signal pair of equal amplitudes but having a quadrature phase relationship, in which the left signal leads the right by 90° of phase; similarly at the "down" point, the left signal lags the right by 90°.

In order to generate the signal components corresponding to these directions, it is necessary to use wide-band all-pass quadrature phase difference networks, which tend to be expensive as they require high precision components. Therefore, most surround sound processors today do not employ the up-down axis either for detection or matrixing purposes, although the majority of older quadraphonic encoding and decoding formats, such as SQ, QS, BMX and BHJ (Ambisonics), used such phase quadrature networks in varying ways.

One tenet of the Ambisonics theory of Gerzon et al. which has been largely followed in modern surround sound processors is that consistent encoding may be obtained if the locus of sound directions encoded around the listener in the horizontal plane forming a great circle on the energy sphere. In the Ambisonics or BHJ matrix, this plane is tilted and somewhat distorted to better approximate the optimum performance related to human hearing; however, good results can also be obtained by using the horizontal plane only of the energy sphere, which results in economy by removing the need for quadrature phase networks. The original Scheiber matrix used such a pan locus, and as Scheiber first used the energy sphere representation (originally due to Poincaré) in the context of quadraphony, it became known as the Scheiber sphere.

Although prior art surround sound processors and those of the present inventor's previous patents employ detectors capable of generating control voltage signals corresponding to the front-back and left-right axis components of the signal, the present invention generates control voltage signals corresponding to the left front-right front (LF-RF) and left back-right back (LB-RB) axes, shown in FIG. 1 on the horizontal plane forward and rearward of the L-R axis. In fact, the LF and RF points are not collinear with the center O of the sphere, so that generation of detector signals based directly on these is not possible. One method by which such signals can be generated is to "boost" the sphere by means of mixing suitable proportions of left and right signals together (see "Transformations of the Energy Sphere" by Martin Willcocks, JAES vol. 31 no. ½, 1983 January/February). This has the effect of swinging the lines O-LF and O-RF backwards until they lie along the L-R axis, also moving the O-L and O-R lines further back and the O-LB and O-RB lines still further back. An opposite boost direction can bring the O-LB and O-RB axes forward to the L-R axis.

To derive control signals equivalent to these axes, a method employed by the present invention employs summation means after the detectors for the L-R and F-B axes to generate detector outputs roughly corresponding to the boosted LF-RF and LB-RB axes.

Another aspect of the present invention concerns the signals that are fed to the various VCA's in order to obtain a stereo to surround synthesis. Two particular modes of operation have been found useful; the first, a forward emphasis mode, derives signals with a primarily frontal location between left, front and right front, with surround sound information located toward the rear. The second mode, a panoramic mode, spreads the front signals more around the listener and more towards the rear. To achieve this, the VCA's are fed with different combinations of the left and right signals, as will be explained further below with reference to FIGS. 9–11.

Figure 2:
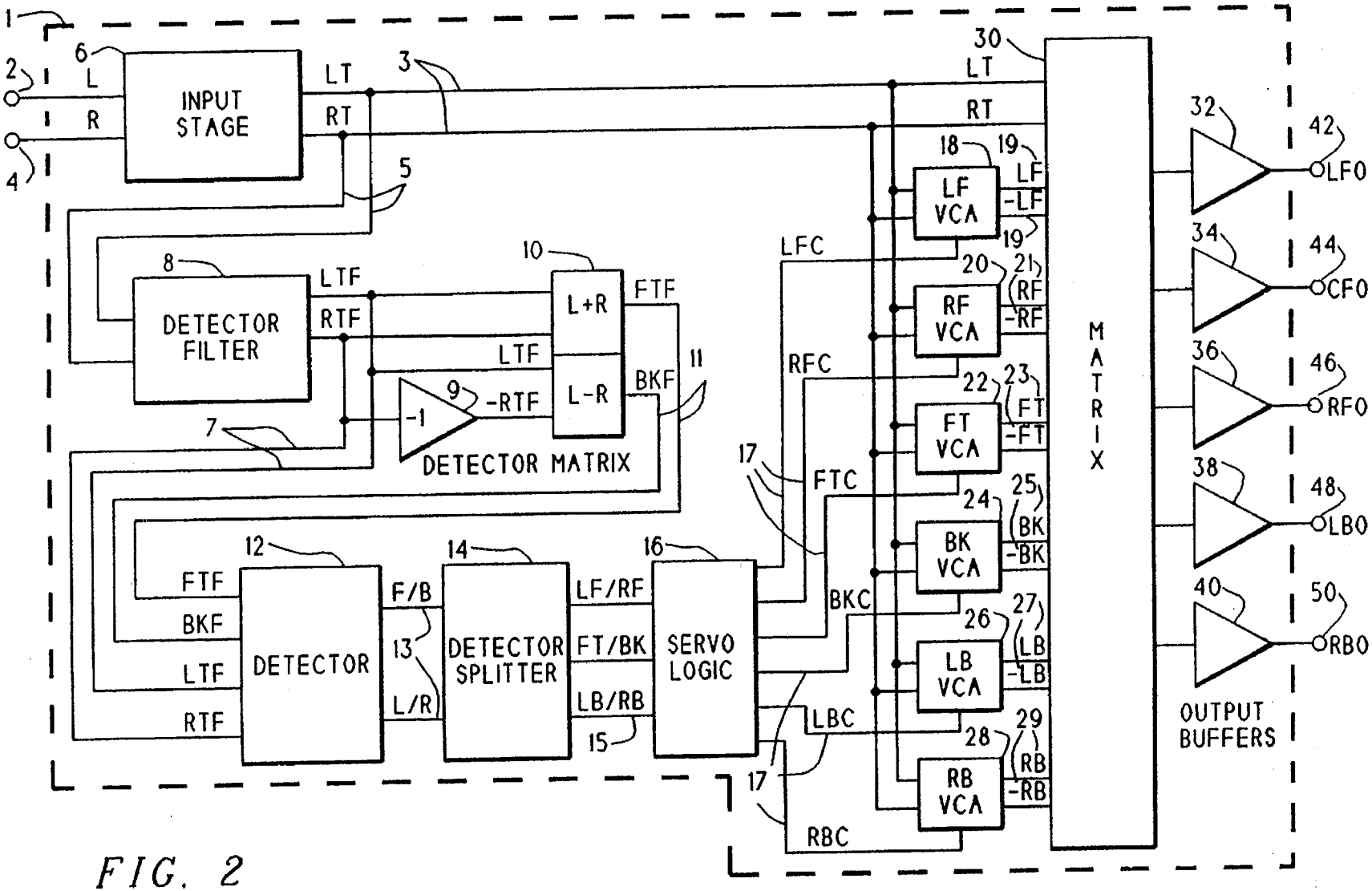
FIG. 2 is a block diagram which illustrates a typical surround sound processor involving the present invention.

Turning to FIG. 2, which is a block schematic of a surround sound processor according to the invention, the processor 1 is equipped with input terminals 2, 4, for receiving left (L) and right (R) audio input signals respectively. These signals are processed by an input stage, 6, typically containing auto-balancing circuitry and other signal conditioning circuits, such as level controls and possibly a panorama control as described in other Fosgate patents or patent applications. A detailed schematic of a simple input stage is shown in FIG. 2, and will be described with reference thereto. The output signals from this stage are labeled LT and RT, and are applied via lines 5 to a detector filter 8, and via lines 3 to VCA's 18–28 and an output matrix 30. Although not shown, to simplify the drawing for improved clarity, the inversions of these signals, —LT and —RT may be generated here and also provided via lines 3 to the VCA's 18–28 and output matrix 30.

The detector filter 8 provides filtered signals LTF and RTF labeled 7 to the inverter 9, the detector matrix circuit 10 and to a detector circuit 12. The signal RTF is inverted by the inverter 9 and also applied to the detector matrix circuit 10. The detector matrix 10 generates outputs 11 labeled FTF and BKF corresponding to front (L+R) and back (L−R) signal directions. These signals are also applied to detector circuit 12, which comprises two identical circuits. One accepts input signals FTF and BKF and produces an output signal F/B at 13, while the other accepts the input signals LTF and RTF to produce an output signal L/R at 13.

The detector output signals 13 labeled F/B and L/R are applied to the novel detector splitter circuit 14, wherein are produced the three signals 15 labeled LF/RF, FT/BK and LB/RB. These in turn are applied to the servo logic circuit 16 to provide s/x control voltage signals 17 labeled LFC, RFC, FTC, BKC, LBC and RBC, for controlling the six VCA's 18 through 28, and labeled LF, RF, FT, BK, LB, and RB VCA respectively.

These VCA's receive the LT and RT signals 3 in different proportions, according to the directional matrix they are intended to provide, and apply their output signals 19 through 29 each in both polarities to the output matrix 30, which also receives the unmodified LT and RT signals 3. As mentioned above, though not shown in FIG. 2, inverters may also be provided for these signals LT and RT to generate —LT and —RT respectively. These inverters may be considered to be a part of the input stage, as their outputs may also be applied to some inputs of VCA's 18 through 28. These details are shown in the accompanying FIGS. 3–11, as necessary for the understanding of the invention, but are not included in FIG. 2 in order to simplify the diagram and improve clarity.

Outputs from the matrix 30 are buffered by amplifiers 32 through 40, providing output signals LFO, CFO. RFO, LBO and RBO at terminals 42, 44, 46, 48 and 50 respectively. These form the five standard outputs of the processor 1, but other outputs (not shown) may also be provided. Typically, the outputs shown may be provided to electronic crossover components in order to provide subwoofer outputs L-SUB, R-SUB and M-SUB (not shown in FIG. 2) as well as the five outputs shown. Such techniques are well known in the art and need no further explanation here.

Figure 3:
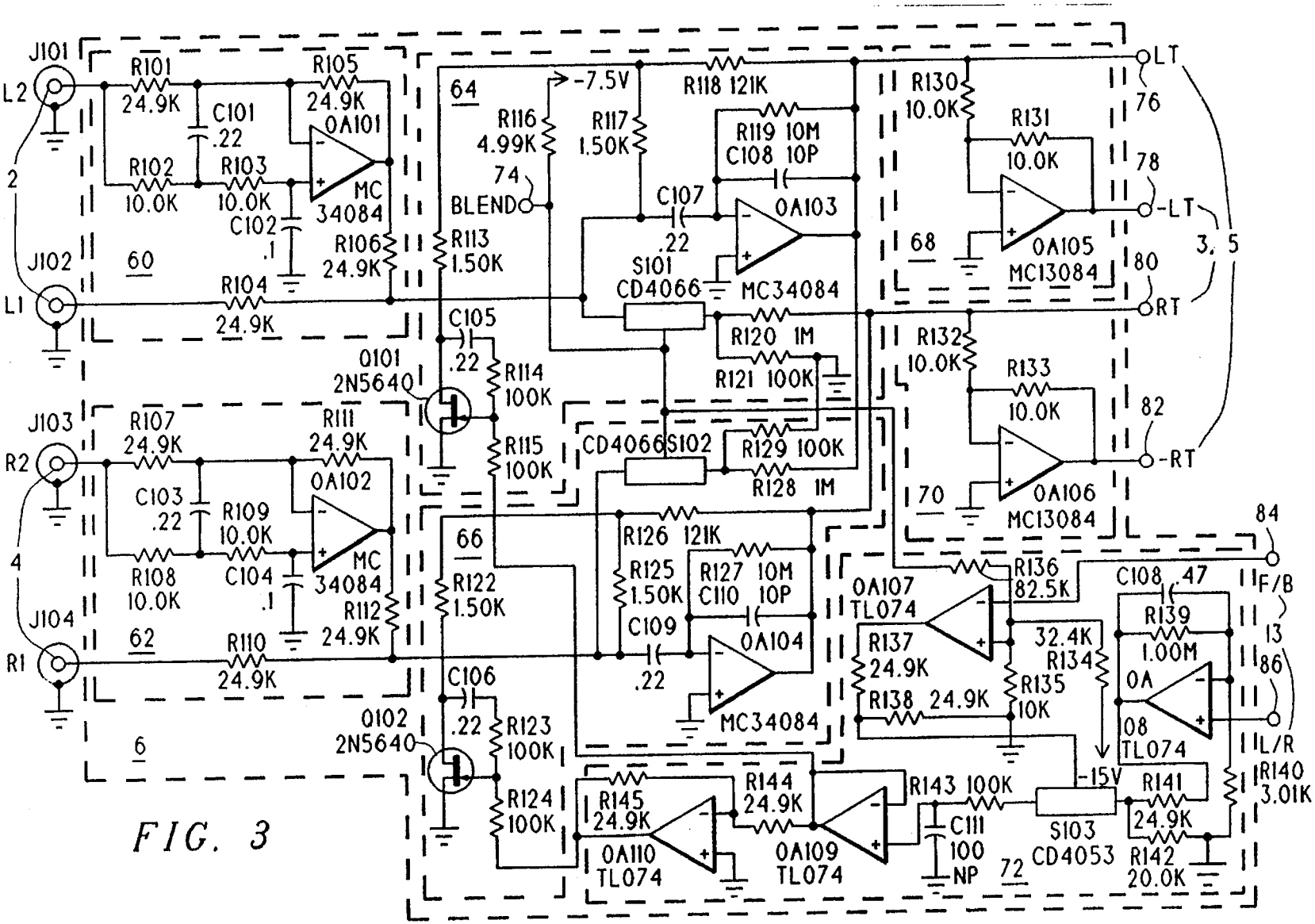
FIG. 3 is a detailed schematic of the input stage of a surround sound processor according to the prior art and suitable for use with the present invention.

Referring to FIG. 3, which shows a typical input stage, 6, suitable for use with the detector and matrix circuitry of the present invention, this input stage comprises a left preamplifier 60 having alternate input jacks J101 and J102, corresponding to terminal 2 of FIG. 2, for receiving the alternate input signals L2 and L1 respectively, a similar right preamplifier 62 having alternate input jacks J103 and J104, 4 in FIG. 2, for receiving the alternate input signals R2 and R1 respectively; left and right gain stages 64 and 66 respectively, left and right inverters 68 and 70 respectively, and an auto-balance circuit 72. Also provided is some switching circuitry for modifying the characteristics of the processor to provide antiphase blending, as disclosed in Fosgate's prior patents and patent applications.

In FIG. 3, the left input signal L1 is passed from the input jack J102 through resistor R104 in the left preamplifier circuit 60 into the left gain stage 64. The alternate left input signal L2 from the input jack J101 goes into a shelf filter circuit forming part of the left input stage 60, comprising operational amplifier OA101 and the surrounding components, resistors R101–R105 and capacitors C101 and C102. This filter provides a specific transfer characteristic which is not the subject of the present invention and will not be discussed further here. The output of the filter stage is applied via resistor R106 to the input of the left gain stage 64.

An identical input stage 62 is provided for the right channel input signals R1 and R2, the right signal R1 from the input jack J104 being applied via resistor R110 to the right gain stage 66, and the alternate right signal R2 from the input jack J103 being applied to the filter stage comprising op-amp OA102, resistors R107–R111, and capacitors C103 and C104, the output of this filter being applied via resistor R112 to the input of the right gain stage 66.

An alternative mode of operation allows the left and right channel input signals to be applied differentially to both pairs of terminals 2 and 4, thereby achieving a different filter characteristic. Optionally, the input circuit 6 may include high pass and low pass filter components (not shown) for use in split-band applications.

The left gain stage 64 has a.c. gain defined by the feedback resistor R118 in conjunction with resistor R117 and the variable attenuator formed by resistor R113 in conjunction with a junction field-effect transistor Q101, resistors R114 and R115, and capacitor C105. When the gate voltage applied to Q101 is zero, the FET is in a low resistance state and about half the feedback current from resistor R118 is bypassed through R113 and Q101, so that the gain stage has a voltage gain of about 10 to either input signal L1 or the filtered input signal L2. The op-amp OA103 has d.c. feedback provided by resistor R119, and its inverting input is a.c. coupled via capacitor C107. Capacitor C108 provides a roll-off at frequencies well above the audio range.

As more negative voltages are applied to the gate of FET Q101 through the resistor R115, its resistance rises, reducing the current shunted away from the feedback current and therefore reducing the gain to a minimum of about 5. Capacitor C105 and resistor R114 provide negative feedback to the gate of Q101 of just the right magnitude to minimize the even-order distortion that otherwise occurs with this type of attenuator, because of the square-law gate transfer characteristic of junction FET's.

An identical gain stage comprising resistors R122–R127, capacitors C106, C19 and C110, op-amp OA104 and FET Q102 provides the same function for the right channel input signals R1 or R2.

CMOS switches S101 and S102 connect resistor R120 from the output of the right gain stage into the input of the left gain stage and resistor R128 from the output of the left gain stage into the input of the right gain stage. Since these gain stages are inverting, when switches S101 and S102 are on, antiphase cross-blending of the signals will occur. When switches S101 and S102 are off, resistors R121 and R129 ensure that a relatively small input voltage is applied to the CMOS switch. The input must not exceed the supply voltages for this chip which are typically +7.5V. The switches are normally off, their control terminals being pulled negative by resistor R116 which goes to the −7.5V supply. They are turned on by applying +7.5V to the terminal 74 labeled BLEND.

The outputs of amplifiers OA103 and OA104 are connected respectively to the output terminals 76 and 80, and the signals present at these terminals are labeled LT and RT respectively. Each of these signals also passes to a unity gain inverter, the left inverter 68 comprising op-amp OA105 with resistors R130 and R131, and the right inverter 70 comprising op-amp OA106 and resistors R132 and R133. The outputs of these inverters are connected respectively to the terminals 78 and 82, labeled —LT and —RT. The signals LT, RT are also identified in FIG. 2 with the numerals 3 and 5, the signals 3 also including the inverted signals —LT and —RT, as stated in the discussion of FIG. 2 above.

The auto-balance circuitry 72 below these inverters receives its input signals 13 from the detector circuitry to be described below with reference to FIG. 5. It should be noted that this auto-balance circuitry is prior art and is not considered part of the present invention, but is included here for completeness as an element of the typical input stage of a decoder according to the present invention.

The F/B signal is applied to terminal 84 to the inverting input of op-amp OA107, which is used as a voltage comparator. The non-inverting input of this op-amp is biased to a negative voltage by the resistors R134 to the −15V supply and R135, taken to ground. The voltage at their junction is about −3.9V with the BLEND signal at terminal 74 left open or connected to −7.5V. When the BLEND signal is taken to +7.5V, a small current is applied to this junction via the resistor R136, changing the voltage to about −2.9V. Thus, whenever the F/B signal goes more negative than the bias voltage applied to the non-inverting input of op-amp OA107, its output swings to the +15V supply rail, and the voltage at the control port of CMOS switch S103, provided by the resistive voltage divider comprising resistors R137 and R138, goes to about half this voltage or just under +7.5V, turning this switch on. At other times, the comparator OA107 has a negative output and the voltage applied to switch S103 is about −7.5V, turning it off.

The signal L/R represents the log-ratio between left and right signal amplitudes. It is applied via terminal 86 to the non-inverting input of op-amp OA108, which is connected as a non-inverting amplifier, with feedback resistor R139 and resistor R140 from the inverting input to ground. Because this amplifier has a very high voltage gain, of about 150 to the junction of resistors R141 and R142, which form a voltage divider to prevent the level at the input of the CMOS switch S103 from exceeding its ±7.5V supply rail voltages, it responds to very small imbalances between the left and right signal amplitudes.

Thus, when the signal is predominantly frontal, which typically occurs when dialog is present in a movie or a soloist is performing in a music recording, the switch S103 is turned on, and the imbalance signal at the output of op-amp OA108 is passed via S103 to the resistor R143 and capacitor C111, which form an integrator with about a ten second time constant. The voltage at C111 is buffered by the op-amp OA 109, connected as a non-inverting source follower. This voltage represents the long-term average imbalance due to slightly different left and right signal levels during such events as dialog and solo performances, etc. It is applied directly to the left channel attenuator formed by FET Q101, with resistors R113–R115 and capacitor C105, and therefore reduces the left channel gain appropriately if the left channel signal predominates during these events. It is also inverted by op-amp OA110 with resistors R144 and R145, and applied to the right channel attenuator formed by FET Q102 with the associated resistors R122–R124 and capacitor C106, so that if the right channel signal predominates during such events, the right channel gain is reduced by an appropriate amount without affecting the left channel gain. The degree of balance correction that can be achieved is up to about 6 dB in either direction.

Auto-balance circuits of this type are useful in providing for correction of improper balance, often due to the large numbers of stages that the stereophonic signals pass through prior to recording or transmission, if insufficient care is taken in the recording process, but can affect the correct performance when a soloist is deliberately recorded slightly to the right or left of center, such as in an orchestral concerto. Therefore, there is usually a provision (not shown in FIG. 3) to turn off the auto-balance circuit. The auto-balance circuit characteristics are different for the case when the BLEND switch is on, because in this mode it has been found preferable to allow the auto-balance circuit to respond to input signals with a slightly wider range of imbalance.

Figure 4:
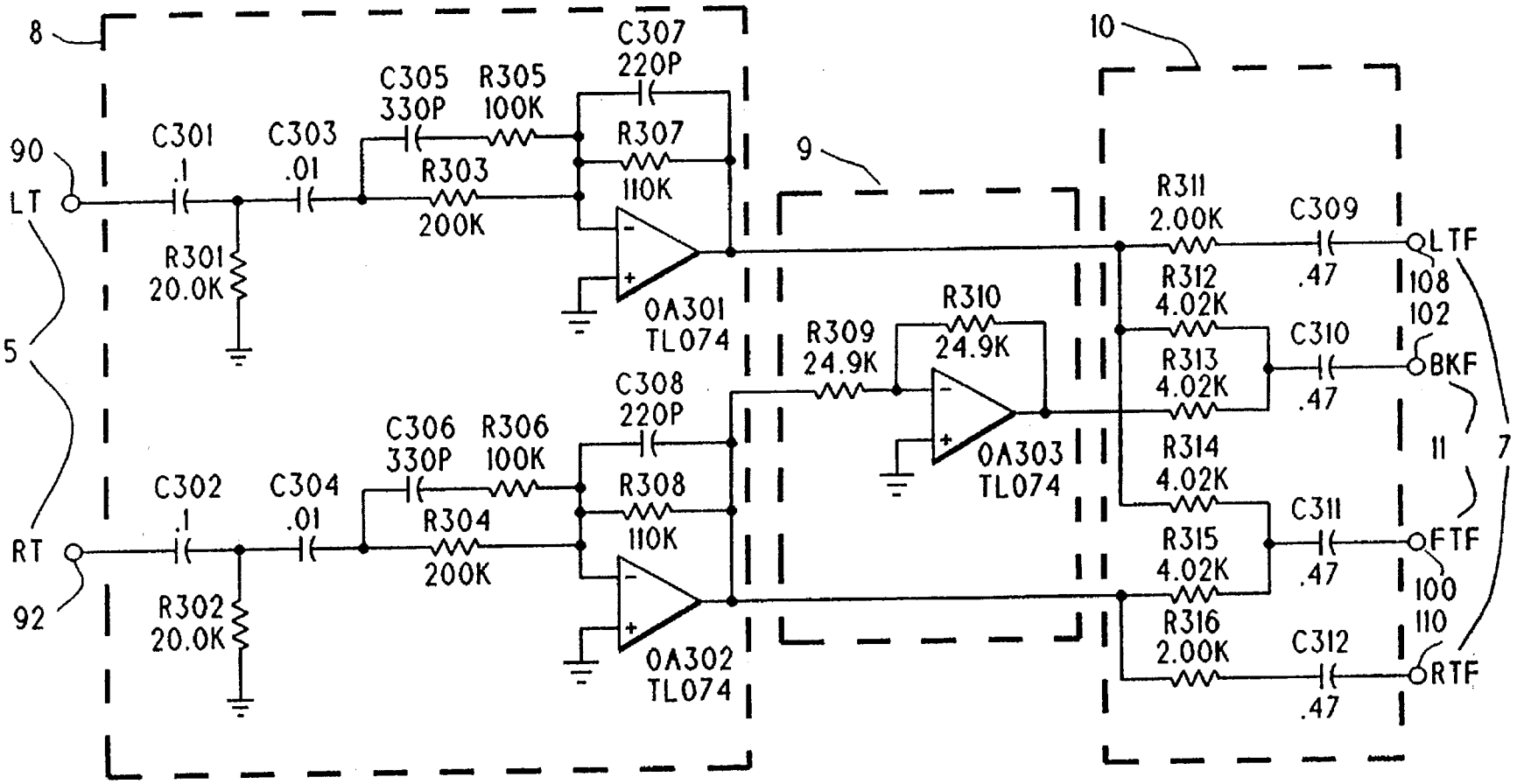
FIG. 4 is a detailed schematic of a detector filter and matrix according to the present invention.

Referring to FIG. 4, which shows a detailed schematic of a detector filter 8, inverter 9, and detector matrix 10, also according to prior art circuitry disclosed in previous Fosgate patents, input terminals 90 and 92 are provided for receiving the signals 5 labeled LT and RT respectively. These signals 5 are filtered by the first stage comprising operational stoplifter OA301 and its associated components for the signal LT, and op-amp OA302 with its associated components for the signal RT. The outputs of this filter stage 8 are passed to the inverter 9 and to the detector matrix 10. The right channel filter output is inverted by inverter 9 which comprises op-amp OA303 with input resistor R309 and feedback resistor R310, with typical values shown. The output of op-amp OA301 is fed via resistor R311 and capacitor C309 in series to output terminal 108, providing a filtered current signal LTF. The output of op-amp OA302 is fed via resistor R316 and capacitor C317 to output terminal 110 providing the filtered current signal RTF. The outputs of both op-amps OA301 and OA302 are combined via resistors R314 and R315 and capacitor C311 to provide the filtered current signal FTF at output terminal 100, and the outputs of op-amps OA301 and OA303 are combined via resistors R312 and R313 and capacitor C310 to provide the filtered current signal BKF at output terminal 102. This circuit is essentially similar to detector filters disclosed in Fosgate's earlier patents and patent applications, cited above.

Figure 5:
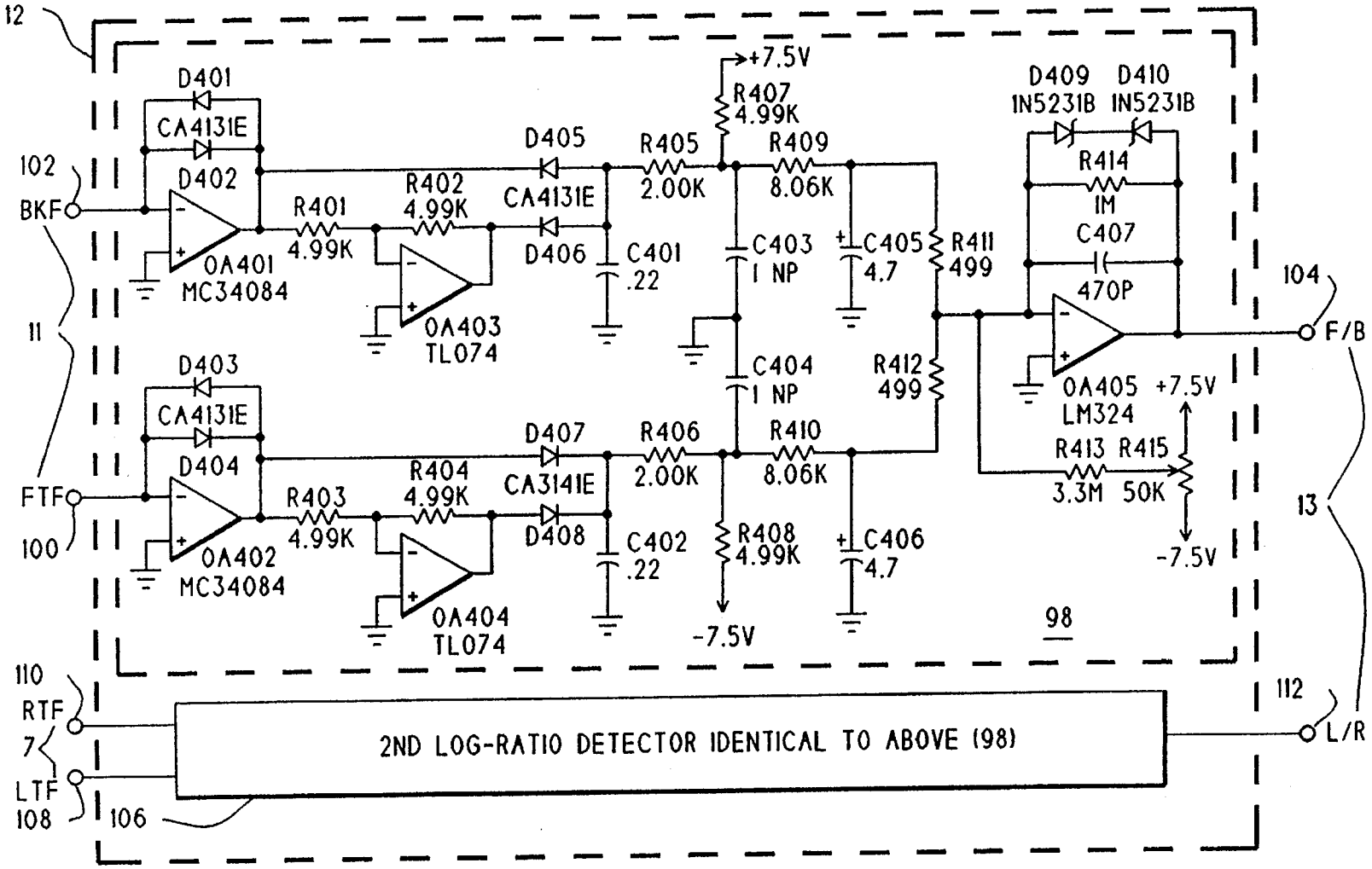
FIG. 5 is a detailed schematic of an improved log-ratio detector according to the present invention.

In FIG. 5 is shown a detector circuit 12 according to the present invention. Although it is generally similar to the detector circuits of Fosgate's earlier patents and patent applications, this circuit differs from them in providing an improved detector filter and by providing symmetrical limiting using zener diodes. It comprises two identical circuits 98 and 106.

In the circuit 98, terminals 100 and 102 respectively accept the filtered current signals 11 labeled FTF and BKF from the outputs of the detector filter of FIG. 4. These signals BKF and FTF are respectively applied to the inverting virtual ground inputs of op-amps OA401 and OA402, which have matched monolithic diodes D401, D402 and D403, D404, connected in antiparallel as their feedback elements, their non-inverting inputs being grounded. These diodes perform a logarithmic function on the inputs as they have a strictly exponential current to voltage relationship. These signals are applied to full-wave rectifiers comprising inverter OA403 with matched diodes D405 and D406 and matched resistors R401 and R402, and inverter OA404 with matched diodes D407 and D408 and matched resistors R403 and R404. Thus far, the log-ratio detector of the present invention follows the prior art topology.

An improved filter circuit for the BKF rectifier comprises the resistors R405 and R409 and capacitors C401, C403 and C405. Resistor R407 provides forward bias current for the diodes D405, D406. An exactly similar circuit is provided for the FTF rectifier, comprising resistors R406, R410, capacitors C402, C404 and C406, with resistor R408 providing bias current for diodes D407 and D408. The two filter outputs are combined by resistors R411 and R412 into the virtual ground inverting input of op-amp OA405, which has a feedback resistor R414 and capacitor C407, and employs two zener diodes D409 and D410 connected back to back and in series to provide symmetrical limiting of the control signal generated by the rectifiers. Resistor R413 and trimpot R415 provide adjustable offset compensation to op-amp OA405, whose output at terminal 104 is the F/B detector output signal. This signal goes positive for signals having predominantly antiphase or back information, and negative for signals having predominantly in-phase or front information content.

An exactly similar circuit 106 provides the output signal L/R, which goes negative for left and positive for tight signals, at terminal 112, when provided with inputs RTF and LTF at terminals 108 and 110 respectively. The F/B and L/R output signals 13 are then applied to the detector splitter. They are also connected to the auto-balance circuit of FIG. 3, as shown therein, although this connection is not shown in FIG. 2.

Although the changes to the filter circuitry in FIG. 5, relative to previous log-ratio detector circuitry disclosed in Fosgate's previous patents and patent applications, appears simple, the modifications greatly improve detector performance, particularly in providing signals that are more accurately related to the dominant information in the sound field, with much lower ripple, and less sensitivity to low-level information and artifacts in the input signals.

Figure 6:
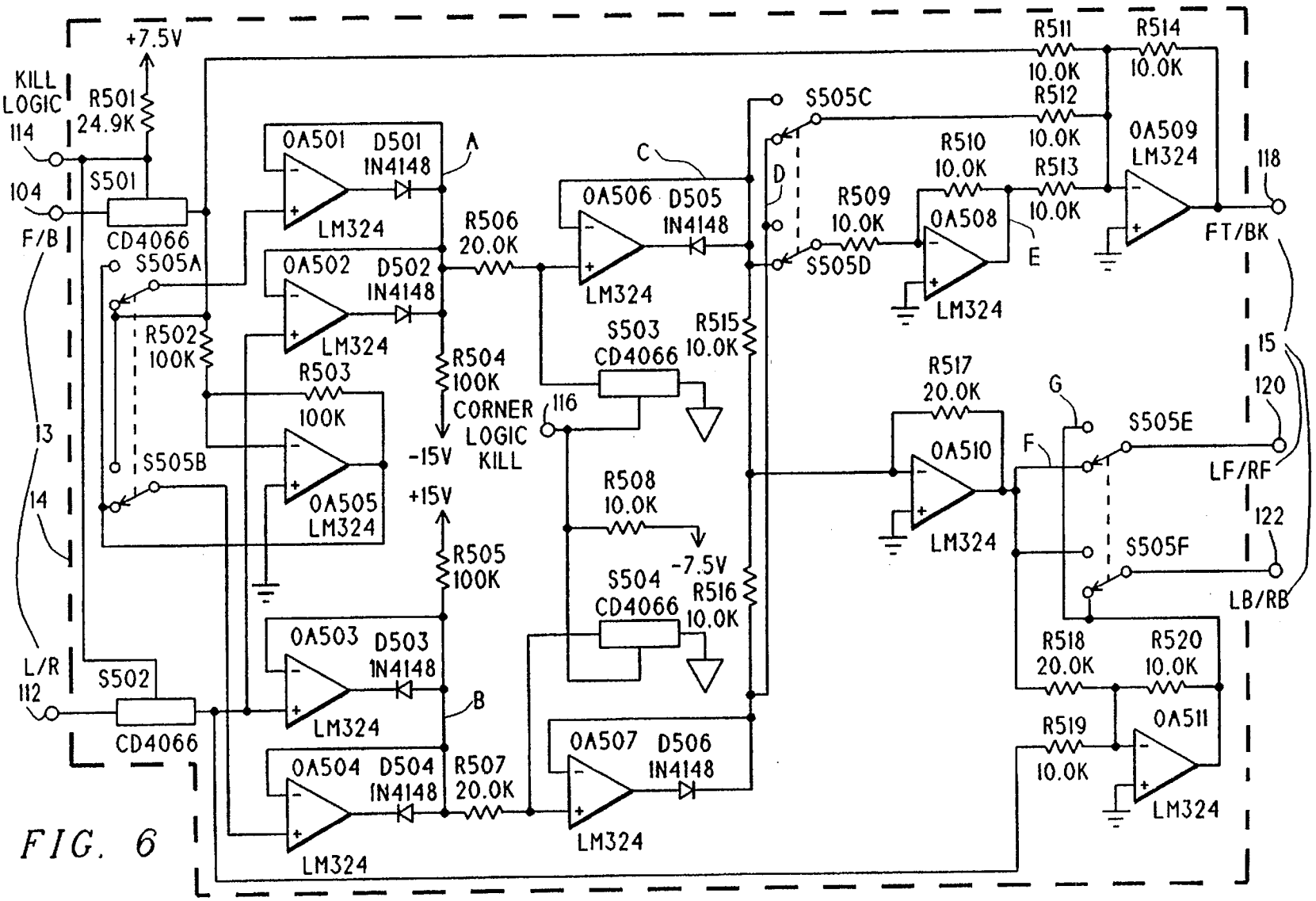
FIG. 6 is a detailed schematic of a detector splitter circuit according to the invention.

In FIG. 6, the incoming detector signals 13, labeled F/B and L/R, and applied to terminals 104 and 112 respectively, are split in a novel detector splitter circuit 14 to provide the output signals FT/BK, LF/RF and LB/RB. This circuit is central to the improvements made in the present invention. To facilitate its understanding, reference should also be made to the graphical representation of the logic voltages shown in FIG. 7, as the direction of the signal varies from back B through left back LB, left L, left front LF to front F, then through right front RF, right R, and right back RB to back B once again.

Though not essential to the operation of this circuit, the signals F/B and L/R first pass through CMOS switches S501 and S502, which have their control inputs connected to the terminal 114 labeled KILL LOGIC with a pull-up resistor R501 ensuring that the switches are normally turned on, unless KILL LOGIC is pulled low to −7.5V. Evidently, when this is done, no signals reach the remaining circuitry of FIG. 6, and the outputs FT/BK, LF/RF and LB/RB remain zero under all signal conditions.

A multi-pole switch S505 with poles labeled S505A through S505F enables the circuit to operate in one of two different modes, a first mode suitable for reproduction of stereo recordings with a frontal emphasis and a second mode suitable for reproduction with a panoramic effect. The switch is shown in the first position selecting the first mode. This switch is not actually present in this form in the full circuit of the surround sound processor but the switching functions it represents are carried out by other control means.

Figure 7:
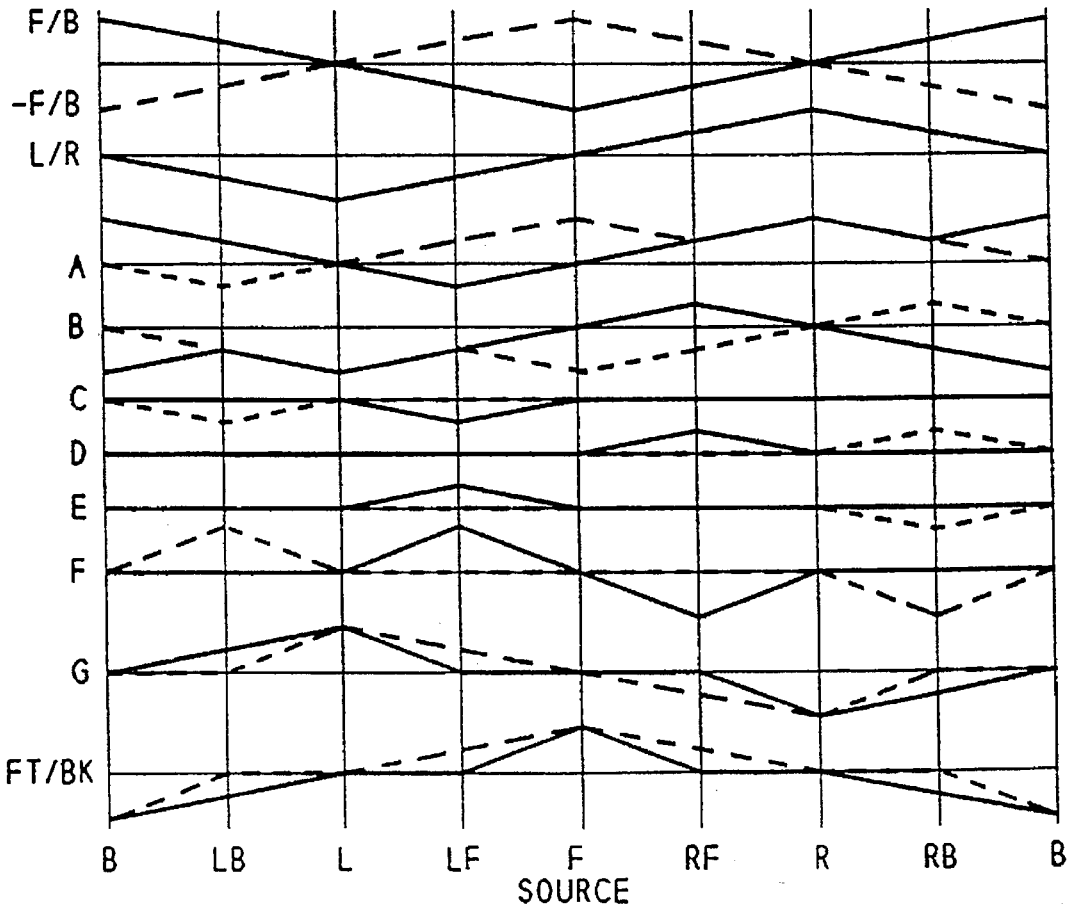
FIG. 7 is a graphical representation of the outputs of the detector splitter circuit of FIG. 6.

The F/B signal, shown as the solid curve on the top line of FIG. 7, is applied via switch S501 to the non-inverting input of an op-amp OA501, connected as a positive half-wave rectifier, such that when its non-inverting input signal is more positive than its inverting input, its output goes positive until diode D501 conducts, and when its non-inverting input is negative with respect to its inverting input, its output goes negative, cutting off diode D501. The F/B signal is also applied to the inverter comprising op-amp OA505 with input resistor R502 and feedback resistor R503 defining its gain of −1. The output of this inverter, —F/B, is shown as the dashed curve on the top section of FIG. 7.

The L/R signal, shown on the second line of FIG. 7, is applied via switch S502 to the non-inverting input of op-amp OA502, with diode D502, also connected as a positive half-wave rectifier. Since R504 biases the junctions of diodes D501 and D502 into conduction, the voltage appearing at this junction, point A, is the more positive (or less negative) one of the two signals F/B and L/R. This is the solid curve on the third line of FIG. 7.

Op-amp OA503 also receives its input from the switched L/R signal and with diode D504 is configured similarly to OA502 and D502, except that the diode polarity is reversed, thereby providing a negative half-wave rectifier. In the first position of switch S505B, op-amp OA504 receives the —F/B signal from inverter OA505. Op-amp OA504 and diode D504 act as a negative half-wave rectifier. Since resistor R505 biases the diodes D503 and D504 positively, the voltage at their junction point B is therefore the more negative or less positive one of the signals L/R and —F/B. The resulting signal at point B is shown as the solid curve on the fourth line of FIG. 7.

The signal at point A, the junction of diodes D501 and D502, is applied via a resistor R506 to the non-inverting input of op-amp OA506, which with diode D505 is connected as a negative half-wave rectifier. A CMOS switch S503 is connected between this point and ground. Similarly, the junction of diodes D503 and D504, point B, is connected via a resistor R507 to the non-inverting input of op-amp OA507, which forms a positive half-wave rectifier with diode D506. This point is also connected via switch S504 to ground.

Both switches S503 and S504 have a common control input from terminal 116 labeled CORNER LOGIC KILL, which is biased to −7.5V via resistor R508. When the voltage on terminal 116 is switched positive, both switches S503 and S504 ground the inputs of op-amps OA506 and OA507 respectively, disabling them.

The output signal of op-amp OA506 at point C goes negative whenever both F/B and LfR signals are negative, and follows the one of these that is less negative. This is represented in FIG. 7 by the solid curve labeled C on the fifth line, which is zero except for the portion between L and F, and reaches its maximum negative excursion at LF.

The output of op-amp OA507 at point D goes positive whenever both L/R and —F/B signals are positive, following the less positive one of these signals. This is represented by the curve D on the sixth line of FIG. 7, which is zero except between F and R, and reaches its maximum positive excursion at RF.

Points C and D go to the remaining circuitry of FIG. 6 in one of two different ways, this being represented by a multi-pole double throw switch S505 having two poles labeled S505C and S505D.

In the first position of switch S505, point C is connected via switch pole S505D to the input resistor R509 of an inverting amplifier OA508, which has a feedback resistor R510 defining its gain as −1. At its output at point E, therefore, the signal is the inverse of that at C, and is shown on the seventh line of FIG. 7 as the solid curve.

The F/B signal is connected through resistor R511 to a summing junction at the virtual ground inverting input of op-amp OA509. Point D is connected via an equal summing resistor R512 and point E via another equal summing resistor R513 to the summing junction at the inverting input of op-amp OA509, so that the signals D, E and F/B are summed. Op-amp OA509 has an equal feedback resistor R514, and its output is connected to the terminal 118 to provide the signal FT/BK, which is the inverted version of the sum of signals D, E, and F/B, shown as the solid line FT/BK at the bottom of FIG. 7. Between L and R, this signal remains at zero from L to LF, rises to maximum at F, falls back to zero at RF, remaining at zero to R. In the back half it is identical to the —F/B signal.

The signals C and D are summed into the input of op-amp OA510 through summing resistors R515 and R516 respectively, the gain of this summing amplifier being defined by the feedback resistor R517 to be 2. The output of OA510 will therefore swing positive in the region between L and F, and negative in the region between F and R, but remain zero between L and B or between R and B. This output signal at point F is shown as the solid curve on the eighth line of FIG. 7.

In the first position of switch S505, the signal at point F is connected through switch pole S505E to appear at the LF/RF output terminal 120.

The signal at point F is also fed via summing resistor R518 to the summing junction at the inverting virtual ground input of op-amp OA511, and the L/R signal is fed to this junction via the summing resistor R519, of half the value. The sum of these two signals is produced at the output G of op-amp OA511, which has a feedback resistor R520 defining its gain to be unity with respect to the signal L/R.

The contribution from the signal at point F causes the signal at point G to follow the pattern of the solid curve on the ninth line in FIG. 7. Beginning at zero at the back point B, this signal rises to the most positive value at the L point, retraining to zero at LF, remaining at zero from LF to RF, then falling to the negative maximum value at R and rising back to zero at B once again. With switch pole S505F in the first position, this output appears at the terminal 122, labeled LB/RB.

In the first mode, then, the sum of the magnitudes of the control signals FT/BK, LF/RF and LB/RB is maintained as more or less a constant value, and furthermore, only two of the three signals are non-zero at any point on the pan locus. This is important to ensure that undesirable effects do not occur, as happens typically when more than two control voltage signals are partially on at the same time, or if the sum of the control signals is allowed to exceed the value any one of them reaches at its maxima.

In the second mode of operation, the switch S505 with poles S505A through S505F are in the alternate position to the position shown. The F/B signal is connected via switch S505B to the input of op-amp OA504, while the inverted signal —F/B from the output of op-amp OA505 now goes via switch S505A to the input of op-amp OA501. Thus the polarity of the front-back signal at these inputs is reversed.

Since point A now follows the more positive of —F/B and L/R, as shown by the dashed curve on the third line of FIG. 7, it is negative only in the region between L and B. Similarly, point B is now the more negative of L/R and F/B, and follows the dashed curve on the fourth line of FIG. 7, and is positive only between R and B.

Point C therefore goes negative between R and B, remaining zero elsewhere, while point D goes positive between B and L, remaining zero elsewhere. These signals are shown as dotted curves on the fifth and sixth lines of FIG. 7, respectively.

With switch S505D in the alternate position to that shown, the signal at point E is now the inversion of that at point D, and follows the dotted curve on the seventh line of FIG. 7. The signal at point F, which is the inverted sum of the signals at points C and D, now follows the dotted curve on the eighth line of FIG. 7, going positive between B and L, zero across the front, and negative between R and B. This output signal at point F is applied via switch pole S505F to the LB/RB terminal.

In the second position of switch S505, the signals at points C and E are summed through resistors R512 and R513 respectively into the virtual ground at the inverting input of op-amp OA509, with the F/B signal from S501 via resistor R511, and the feedback resistor R514 provides unity gain, so that the output of op-amp OA509, labeled FT/BK and appearing at terminal 118, is the inversion of the sum of the three signals F/B, C and E. This is shown at the bottom line of FIG. 7, following the dashed curve. It is at its maximum negative value at B, rising to zero at LB, to maximum positive at F, then falling to zero at R, remaining zero between R and RB, and falling again to its maximum negative value at B.

Once again, the sum of the magnitudes of the three signals FT/BK, LF/RF and LB/RB is maintained at approximately the maximum value reached by any one of them, and only two of them are non-zero at any point on the pan locus. However, it should be noted that in the first position of switch S505, the LF/RF signal peaks at the points LF and RF on the pan locus, and the LB/RB signal peaks at L and R, while in the second position of switch S505, the LF/RF signal peaks at the points L and R on the pan locus, and the LB/RB signal peaks at the points LB and RB.

In either the first or second mode of operation, as selected by switch S505, when CORNER LOGIC KILL is in effect, the signals at points C and D become zero, and therefore so do the signals at points E and F, disabling the entire central portion of FIG. 6. The output G of op-amp OA511 in this case is the inversion of the L/R signal, while the output of op-amp OA510 remains identically zero, and the FT/BK signal follows the —F/B signal. Note that point G is still switched between the LF/RF terminal 120 and the LB/RB terminal 122, the other of these terminals being switched to point F, which remains at zero potential.

Figure 8:
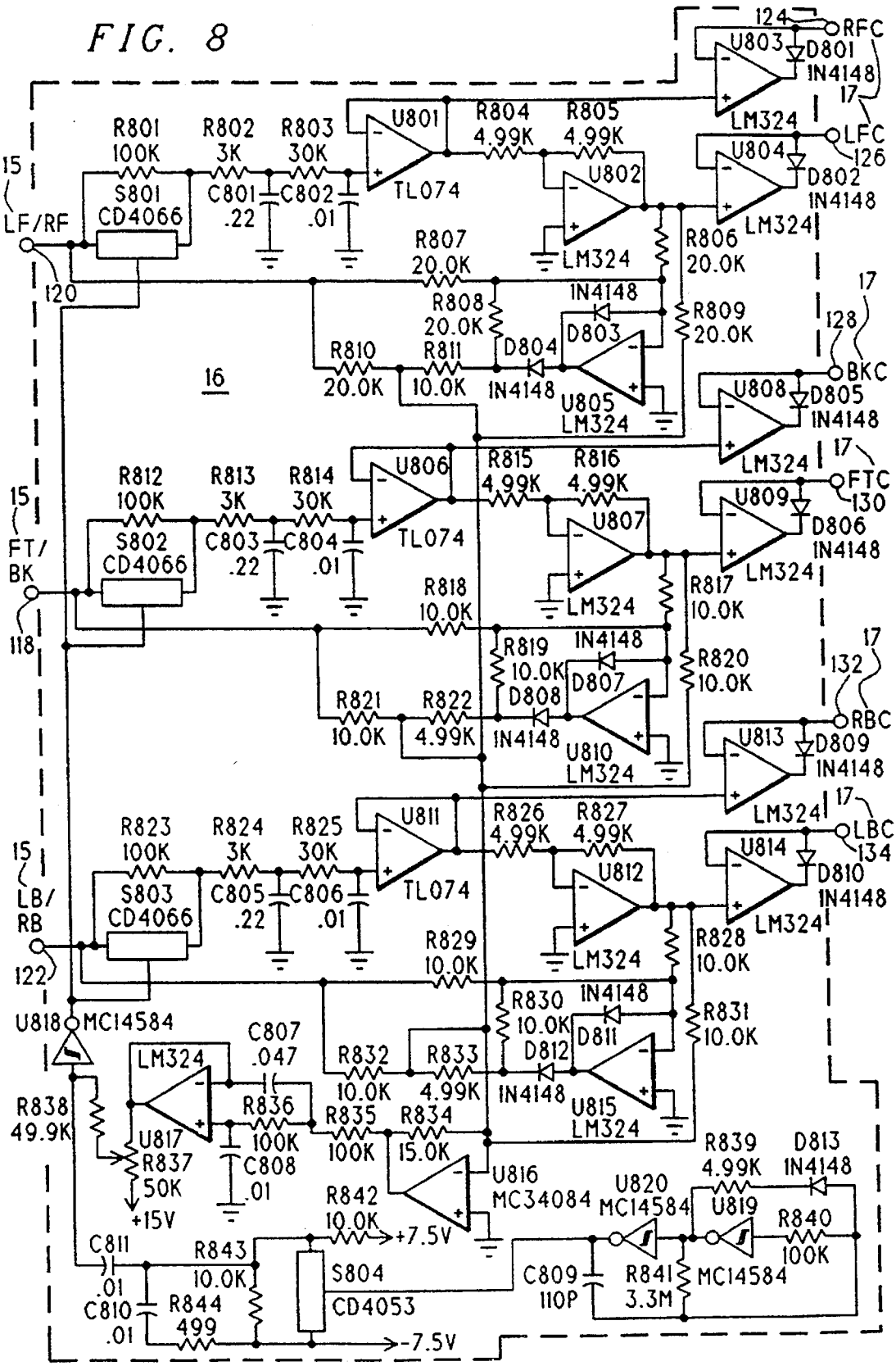
FIG. 8 is a detailed schematic of a three-axis servologic circuit according to the invention.

FIG. 8 shows a three-channel servologic system, 16, in which the three detector splitter output signals 15, labeled LF/RF, FT/BK and LB/RB, are each filtered through variable low-pass filter elements realized with pulse width modulation circuitry, and then are buffered and split into pairs of control voltage signals 17 labeled RFC, LFC, BKC, FTC, LBC and RBC.

The LF/RF signal applied to terminal 120 is passed through a resistor R801 in parallel with a CMOS switch S801, and then through resistor R802 and R803 to the non-inverting input of op-amp U801, connected as a unity gain source follower buffer. Capacitors C801 and C802, connected to ground respectively from the junction of resistors R802 and R803 and from the non-inverting input of op-amp U801, form a two-pole smoothing filter, which represents an improvement over the single-pole type of filter used in prior servologic circuits as shown in Fosgate's previous patents and patent applications.

The action of the CMOS switch S801, when operated at a high frequency by a pulse width modulated (PWM) rectangular waveform of variable duty cycle derived as explained below, is to vary the effective resistance of the parallel combination of resistor R801 and switch S801, thus varying the time constant of these resistors with resistor R802 and capacitor C801 to provide more or less smoothing of the detector splitter output signal LF/RF.

The output of the filter formed by switch S801, resistors R801 through R803 and capacitors C801 and C802 is buffered by the op-amp U801, and inverted by the unity gain inverter formed by op-amp U802 with input resistor R804 and equal feedback resistor R805. It is also passed to the input of a negative half-wave rectifier formed by op-amp U803 and diode D801, whose output is the control voltage signal labeled LFC at terminal 124. Since the signal LF/RF is positive for leftward signals and negative for rightward signals (see FIG. 7), the signal RFC goes negative only for right front or right signals.

The output of the inverter U802 is passed to the input of a negative half-wave rectifier formed by op-amp U804 with diode D802, whose output is the control voltage signal LFC appearing at terminal 126. This goes negative only for left or left front signals.

The signal FT/BK applied to terminal 118 is processed in exactly the same manner by the identical variable filter, inverter and rectifier circuit comprising CMOS switch S802, resistors R812 through R816, capacitors C803 and C804, diodes D805 and D806, and op-amps U806 through U809, to provide output control voltage signals BKC and FTC at terminals 128 and 130 respectively. Since FT/BK is negative for signals in the back half of the pan locus, the signal BKC goes negative for back signals, and the signal FTC taken from the inverter U807 goes negative for front signals.

Similarly, the signal LB/RB applied to terminal 122 is processed in the same manner by the identical variable filter, inverter and rectifier circuit comprising CMOS switch S803, resistors R823 through R827, capacitors C805 and C806, diodes D809 and D810, and op-amps U811 through U814, to provide output control voltage signals RBC and LBC at terminals 132 and 134 respectively.

The switches S801 through S803 in these three identical circuits are operated by a common PWM rectangular wave driven from the output of Schmitt trigger inverter U818, which signal is generated by the remaining circuitry of FIG. 8 as explained below.

The signal LF/RF is applied via a resistor R807 to the inverting input of op-amp U805. The filtered and inverted output signal at the output of op-amp U802 is also applied through the equal resistor R806 to this point, so that the input current is proportional to the difference between the incoming LF/RF detector splitter output signal and its filtered version after the buffer U801. The op-amp U803, with diodes D803 and D804 and feedback resistor R808, forms a half-wave summing rectifier circuit which provides an output voltage that is the inverse of the difference of LF/RF and its filtered version at U801 whenever this is negative, and is zero whenever the difference signal is positive.

Resistors R810 and R809 respectively from the FT/BK signal and its inverted filtered version at the output of op-amp U802, and resistor R811 from the output of the half-wave rectifier U805, are connected to a common virtual ground summing junction at the inverting input of op-amp U816. The resultant current from these three resistors is the full-wave rectified or absolute value of the difference signal between FT/BK and its filtered version at U801, applied via an effective resistance in this case of 20 kΩ, the value of resistor R810.

A similar full-wave rectifier circuit is formed by op-amp U810 with diodes D807 and D808, and resistors R817 through R822, in the middle section of FIG. 8, providing a current to the common summing junction at the inverting input of op-amp U816 equal to the absolute value of the difference signal between the FT/BK input at terminal 118 and its filtered version at the output of op-amp U806 divided by the effective resistance of 10 kΩ, the value of resistor R821.

Another similar full-wave rectifier circuit is formed by op-amp U815 with diodes D811 and D812, and resistors R828 through R833, in the lower middle section of FIG. 8. This provides a current to the common summing junction of at the inverting input of the op-amp U816 equal to the difference between the LB/RB detector splitter output signal applied to terminal 122 and its filtered version at the output of op-amp U811, divided by the effective resistance of 10 kΩ, the value of resistor R832.

Thus the three input signals LF/RF, LB/RB and FT/BK each contribute to the absolute value current driving the input of op-amp U816 in the lower portion of FIG. 8, but not equally, the LF/RF signal contributing at only half the level of the other two. This applies whatever the position of the switch S505 of FIG. 6 in the detector splitter circuit. This is in order to prevent the operation of the LF/RF control voltage from having too much effect on the responsiveness of the control voltages, particularly in the presence of center front signals such as dialog in movie soundtracks and soloists in many stereo recordings.

The output voltage of op-amp U816 is developed across the feedback resistor R834, and therefore has a gain of 1.5 to the difference signals for FT/BK and LB/RB and 0.75 to the difference signal for LF/RF. It is applied via a two-pole low-pass filter comprising op-amp U817 with associated resistors R835 and R836 and capacitors C807 and C808, to the potentiometer R837, the wiper of which is connected via resistor R838 to the input of Schmitt trigger inverter U818. A bias voltage is applied by returning the potentiometer to 15V.

A high frequency oscillator is formed by the two Schmitt trigger inverters U819 and U820, with associated resistors R839 through R841, capacitor C809 and diode D813. This operates the CMOS switch S804 connected between the negative −7.5V supply voltage and the junction of equal resistors R842 and R843 connected between the positive +7.5V and negative 7.5V supply voltages. A capacitor C810 with resistor R844 in series provides a time constant with these resistors R843 and R842.

When the switch S804 is operated at the frequency determined by the oscillator circuit, a negative-going pulse waveform appears at the junction of resistors R842 and R843, having a fast negative-going leading edge and a much slower exponential shaped trailing edge. This waveform is applied via capacitor C811 to the input of Schmitt trigger inverter U818, and is effectively biased by the d.c. component of the voltage at the wiper of potentiometer R837, which is set such that if the absolute value of the combined difference signals appearing at the output of op-amp U816 is zero, the pulse waveform just barely fails to switch the inverter U818, and hence to operate the switches S801 through S803.

Therefore, in this quiescent condition, the time constants of the servologic filters are all at their longest possible value, defined by R801, R803 and C801, of about 22.7 ms with the resistor and capacitor values shown.

When the output of op-amp U816 goes negative, the pulse waveform is allowed to pass through inverter U818, and its duty ratio increases with the value of the negative-going absolute difference signal, causing the effective resistance of the combinations of switches S801 through S803 with their parallel resistors R801, R812 and R823 respectively, to fall to an effective value of 100kΩ×(1−d) where d is the duty ratio of the PWM signal at the output of Schmitt trigger inverter U818.

This shortens the time constants of each of the three filter circuits, causing them to respond more quickly to changes in the values of the input signals LF/RF, LB/RB and FT/BK. The minimum effective time constant is about 3.5 ms, but the second stage of filtering provided by R803 and C802 in the upper filter and corresponding components in the other filters provides a much smoother output than was the case in prior single-pole filters used in the servologic circuits described in Fosgate's previous patents and patent applications. Both the maximum and minimum time constants are shorter than was previously possible, due to the improved smoothing provided by the extra filter pole, making the circuit significantly more responsive to rapid directionality changes in the audio input signals.

In effect, a negative feedback servo loop also exists in this circuit, as a shorter response time reduces the difference between the input and output of each of the filter circuits, thereby tending to reduce the duty ratio of the PWM signal, hence the term servologic used to describe this circuit.

Thus the servologic circuit provides at its six output terminals a set of control voltage signals which respond to the output voltages produced by the direction detector circuit and the detector splitter circuit in a manner which reflects the speed with which any of these voltages are changing.

The majority of this circuitry is similar to that described in Fosgate's previous patents and patent applications, the novel features of the present circuitry being the extension to provide for three input signals and to generate six output control voltage signals, the provision of a two-pole variable filter circuit which greatly improves the speed and smoothness of operation of the circuit, and the different relative contributions of the LF/RF, LB/RB and FT/BK signals to the absolute difference signal used to control the PWM duty ratio.

Figure 9:
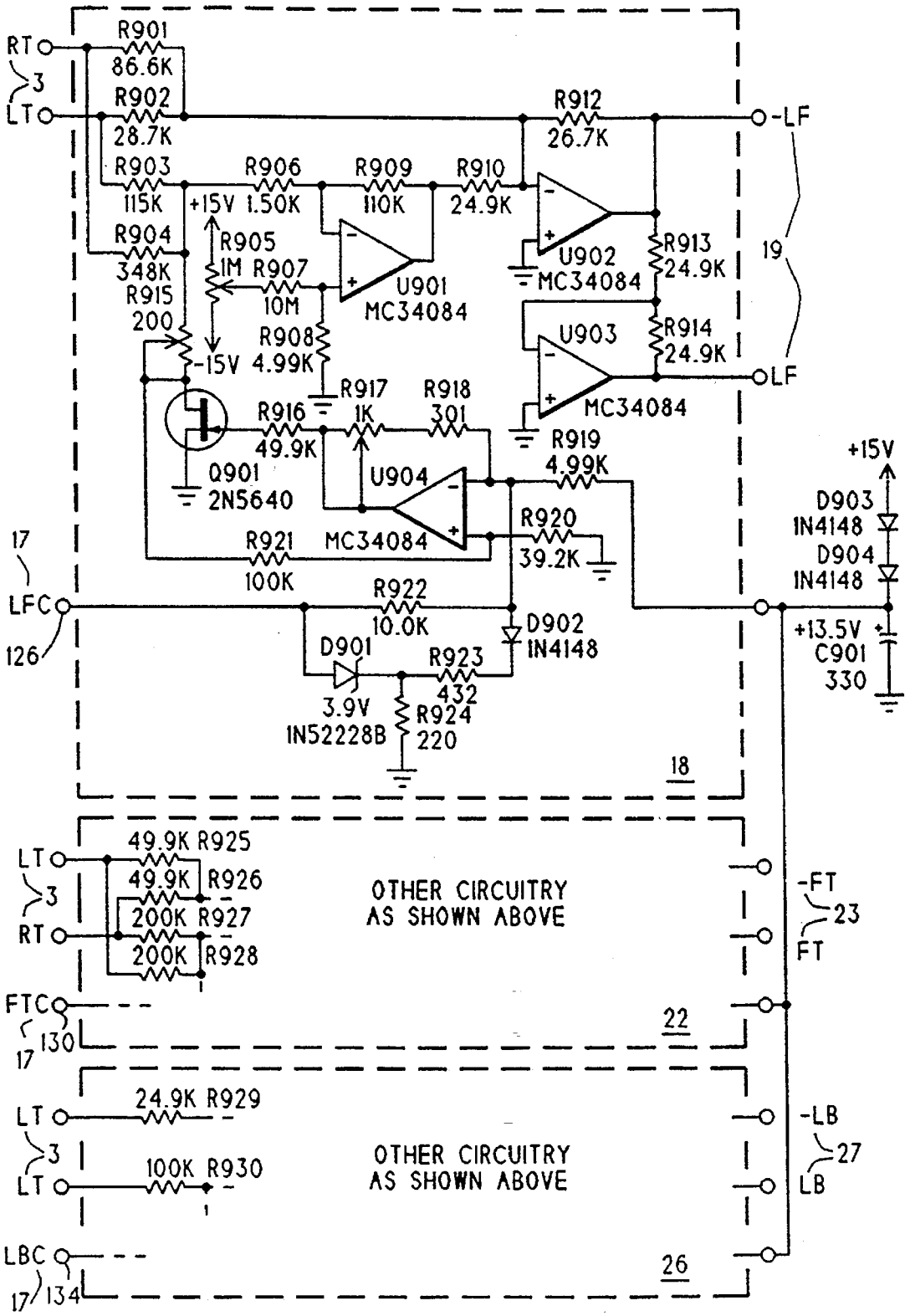
FIG. 9 is a detailed schematic of an improved VCA according to the invention.

Each of these six control voltage signals LFC, RFC, FTC, BKC, LBC and RBC is connected to the control port of a voltage-controlled amplifier, of the type shown in FIG. 9. While this is basically similar to the circuit used in the previous Fosgate patent applications, a novel feature of this circuit is a linearity correction network placed between the control voltage generator and the VCA input.

In FIG. 9, the LF VCA block 18 of FIG. 2 is shown in a detailed form. The LT and RT signals 3 from the input matrix 6 in FIG. 2 are applied via the correspondingly labeled input terminals to a direct path and a side path, the latter incorporating a gain control element. In the direct path, the LT and RT signals are respectively applied through resistors R902 and R901 to the inverting input of op-amp U902, which has a feedback resistor of 26.7k•. The values of R901 and R902 are so chosen that an in-phase blend of LT and RT occurs, the level of RT being about −9.6 dB relative to that of LT, and the gain to a true left front signal is 0.977. For this purpose a true left front signal is defined to have components LT=0.92388V cos wt, and RT=0.38268V cos wt, the effective rms amplitude of the pair being 1.

The side path comprises most of the remaining circuit in the top section of FIG. 9. Resistors R903 and R904 apply the signals LT and RT respectively to a low impedance junction of the resistor R906 and the series combination of potentiometer R915 and junction FET Q901. When the gate of Q901 is near ground potential, the device has an effective series resistance of about 200Ω or less, the difference being taken up by the potentiometer, which is adjusted for an effective total resistance of about 300Ω. Thus about 83% of the total current flows into the FET and only 17% into the 1.5kΩ resistor R906 and hence into the inverting input of op-amp U901. This has a feedback resistor R909 of 110kΩ, and the values of resistors R903 and R904 are approximately four times those of resistors R902 and R901 respectively.

The value of R910 is 24.9K, and the values of R909 and R910 are chosen so that when Q901 is cut off, the signal current through the side chain resistor R910 almost exactly cancels the signal currents in the direct path resistors R901 and R902 flowing into the inverting input of op-amp U902. Thus the gain of the VCA is minimum under this condition. The output of the VCA, the signal —LF, is taken at the output of op-amp U902, and an inverter formed by op-amp U903 with equal resistors R913 and R914 provides the LF signal output, this pair of outputs LF and —LF being identified by the numeral 19 as in FIG. 2.

The potentiometer R905 and resistors R907 and R908 provide an offset compensation voltage to the non-inverting input of op-amp U901 to minimize the DC voltages at the outputs of op-amps U902 and U903 as the gain of the VCA changes.

When FET Q901 has its minimum resistance, the side chain current is proportionally reduced to about 17% of its maximum value, allowing the overall gain to be 83% of the value calculated from the direct path alone.

The resistance of FET Q901 is varied by adjusting its gate voltage. Op-amp U904 provides this gate voltage via a gate current limiting resistor R916.

The LFC control voltage signal 17 from the servologic circuit of FIG. 8 at terminal 126 is applied to the virtual Found inverting input of the op-amp U904 through a linearity correction network comprising zener diode D901, diode D902 and resistors R922 through R904. In addition, a bias current is applied to this input through resistor R919 from a common +13.5V voltage derived from the +15V supply via two series diodes D903 and D904, and decoupled with capacitor C901. The effect of this bias current is to make the voltage at the output of U904 negative, the exact voltage being determined by the setting of potentiometer R917 in series with resistor R918, and is about −3V when LFC is at ground potential. It is set to just below the pinch-off voltage of FET Q901, to the point at which the maximum cancellation of the direct signal is achieved through the side chain signal.

As the LFC control voltage signal at terminal 126 goes negative, the output voltage of op-amp U904 applied to the gate of transistor Q901 rises above the pinch-off voltage and causes the transistors effective resistance to decrease, thereby increasing the attenuation through the side chain and increasing the gain of the VCA. Above a certain negative voltage value, zener diode D901 begins to conduct, and pulls the voltage on resistor R922 negative. Some current begins to flow through resistor R923 and diode D902 when the voltage at LFC goes to about −4.5V. Beyond this, the gain of the control path increases, compensating to some extent for a flattening out of the control voltage signal as it nears −6V, and for the changing characteristics of the VCA as the FET Q901 nears its minimum resistance value.

The resistors R921 and R920 apply a proportion of the a.c. voltage at the drain of FET Q901 to its gate to compensate for even-order distortion introduced by the square-law nonlinearity of the FET. These values have been selected to minimize VCA distortion at all gain settings of the VCA.

In discussing the properties of this VCA below with reference to matrixing in FIGS. 10 and 11, we shall regard the VCA as having a gain coefficient $k_{LF}$ with reference to an effective input resistance of 24.9 k, this being the value shown for R929 in the LB VCA 26 to be further discussed below. In the case of the left front (LF) VCA, the output signal is $k_{LF}$ times the summed signals (0.8676 LT+0.2875 RT), i.e.

$$LF=k_{LF}\,(0.8676\,LT+0.2875\,RT)$$

where LT and RT are the respective amplitudes of the signals in the left and right channels following the input matrix circuit 6.

An exactly similar circuit is provided in the FT VCA block 22 of FIG. 9, also shown in FIG. 2. in this case, however, the resistor values from LT and RT signal inputs are different. Resistors R926 and R925 respectively correspond to resistors R901 and R902 in VCA 18, but have equal values of 49.9 kΩ. Similarly, resistors R927 and R928 correspond to resistors R904 and R904 respectively, but are also equal at 200 kΩ. These values provide maximum gain for a front signal, defined by the equal LT and RT values of 0.70711 V cos wt. The control signal voltage FTC is applied via terminal 130 to a similar nonlinear correction network as shown in the circuitry of VCA 18, and acts to increase the gain of the front VCA as the FTC control voltage signal goes negative. The front outputs are provided at the terminals 23 labeled —FT and FT. In this case the coefficients are each exactly 0.5, yielding the equation $$FT=k_{FT}\,(0.5\,LT+0.5\,RT)$$

Another similar circuit is provided in circuit block 26, the LB VCA of FIG. 2. In this case, there is no RT input, the LT input being applied to resistors R929 and R930 to the direct and side chain paths respectively. The outputs 27 appear at terminals LB and —LB. The LBC control voltage signal is applied to terminal 134. The equation describing this output is still simpler, namely:

$$LB=k_{LB}\,LT$$

The circuitry shown in FIG. 9 represents the left and front VCA's of FIG. 2, but in addition, there are similar VCA's provided for the RFC, RBC and BKC control voltages, in an almost identical circuit (not shown). The RF VCA 20 in FIG.

2 for the RFC control voltage signal is exactly like the LF VCA 18, except that the signals LT and RT are applied to the opposite terminals, i.e. RT is applied to resistors R902 and R903, while LT is applied to resistors R901 and R904. Similarly, the BK VCA 24 is like the FT VCA 22 except that instead of the RT signal, the —RT signal is applied to resistors R926 and R927. In the RB VCA 28, which is exactly like the LB VCA 26, the RT signal is applied to both resistors R929 and R930 instead of the LT signal. As a result, the equations for RF, BK and RB signals are, respectively:

$$RF \times k_{RF}\ (0.2875LT+0.8676\ RT)$$

$$BK=k_{BK}\ (0.5\ LT-0.5\ RT)$$

$$RB=k_{RB}\ RT$$

The configuration of the VCA's in FIG. 9 is shown for the case of switch S505 of FIG. 6 in the first position. There is also an alternative configuration of the VCA's (not shown) for the case when switch S505 is in the alternate position. In this alternative configuration, the top VCA of FIG. 9 becomes the LB VCA 26, and receives the signals LT and —RT, the RB VCA 28 receiving signals RT and —LT. The lower VCA 26 becomes the LF VCA 18. The signals applied to the two lower VCA's of FIG. 9 are unchanged in this alternative configuration, which can be achieved in practice by switching the control voltage inputs and signal inputs and outputs as indicated in parallel with the action of switch S505 of FIG. 6.

The set of signal equations for this alternative configuration is:

$$LF=k_{LF}\ LT$$

$$FT=k_{LT}\ (0.5\ LT+0.5\ RT)$$

$$LB=k_{LB}\ (0.8676\ LT-0.2875\ RT)$$

$$RF=k_{RF}\ RT$$

$$BK=k_{BK}\ (0.5\ LT-0.5\ RT)$$

$$RB=k_{RB}\ (-0.2875\ LT+0.8676\ RT)$$

Figure 10A:
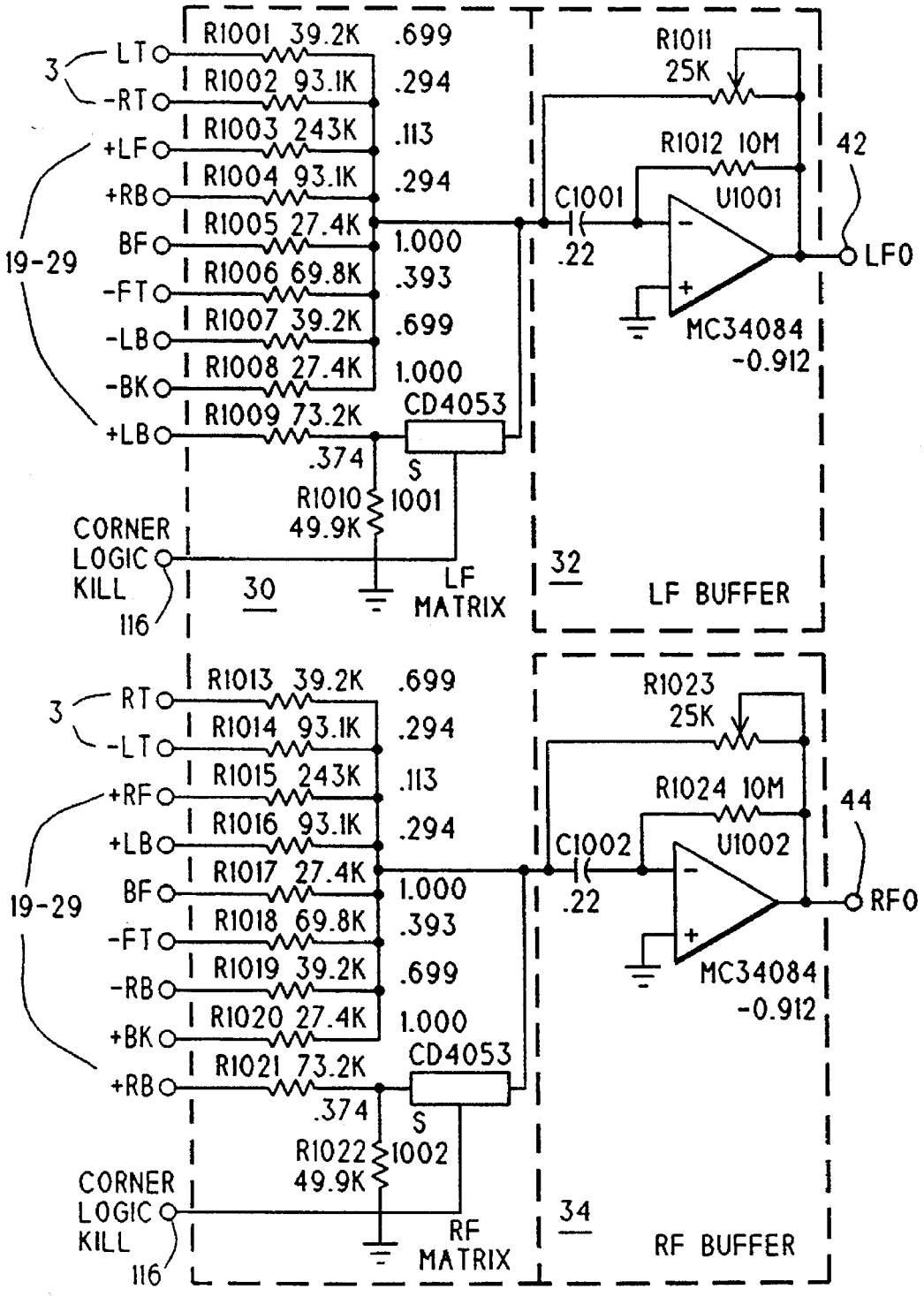
FIG. 10 is a block schematic of a first output matrix configuration according to the invention.
Figure 10B:
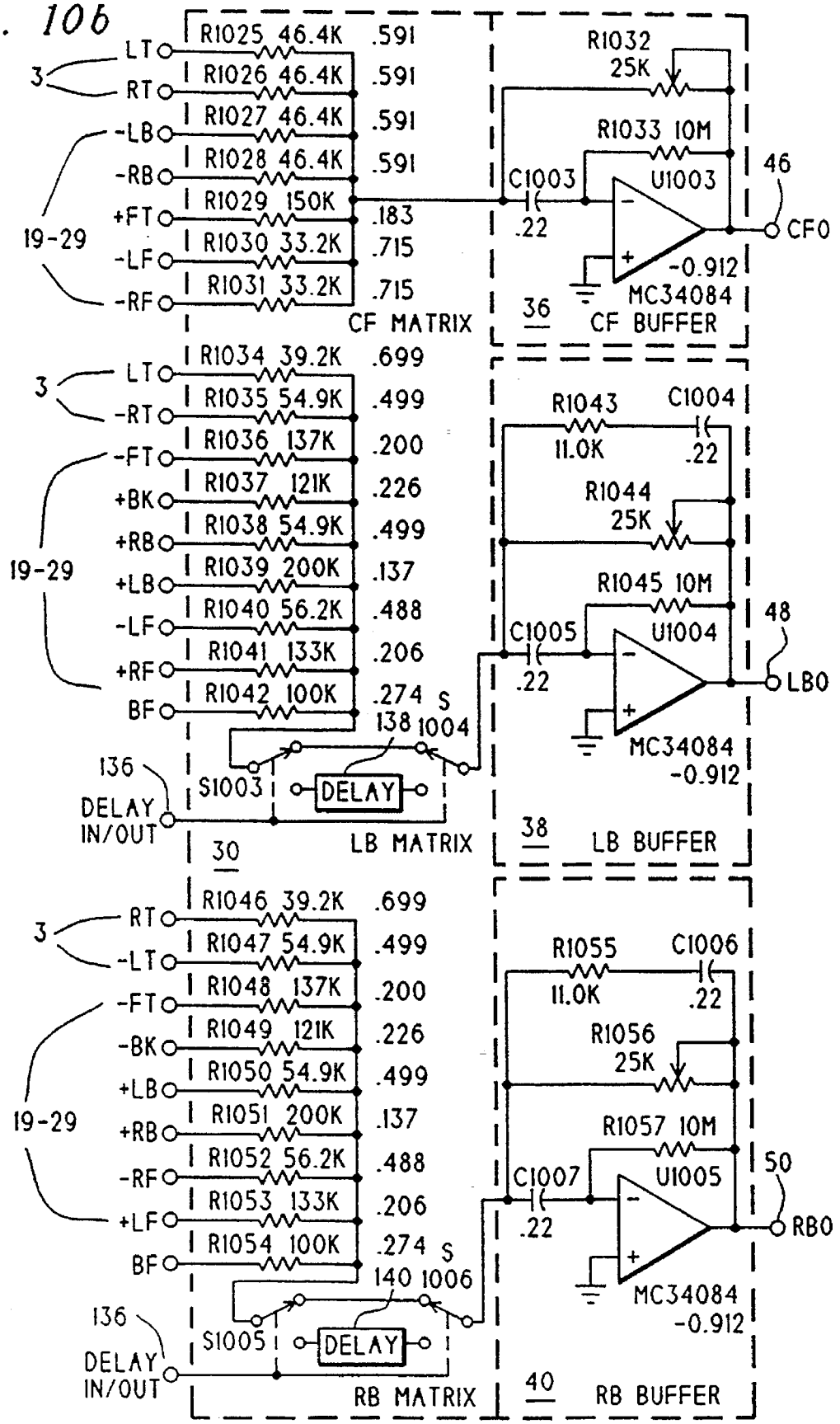

In FIG. 10 is shown a first matrixing network suitable for use with the first mode of the detector splitter circuit of FIG. 6, with switch S505 in the first position as shown. FIG. 10*a* shows the circuitry for the portions of the OUTPUT MATRIX block 30 of FIG. 2 dedicated to the LF and RF outputs, with output buffers 32 and 34, while FIG. 10*b* shows the remaining matrix circuitry 30 for the CF, LB and RB outputs and the output buffers 36, 38 and 40. The circuitry is conventional but the resistors are chosen for the specific matrixing coefficients that are desired for the first mode of the detector splitter circuit of FIG. 6 and the first configuration of VCA's shown in FIG. 9.

In FIG. 10*a*, the LF matrix, part of the matrix block 30 of FIG. 2, comprises the resistors R1001 through R1010 and CMOS switch S1001. These resistors are connected into a virtual ground summing junction at the input of the LF buffer 32, which comprises the op-amp U1001 and associated capacitor C1001 and resistors R1011 and R1012.

The feedback resistor R1011 is adjustable to yield a maximum gain for any input of −0.912. Typically the potentiometer will, however, be set back to give a gain of 0.707 or −3 dB for the largest input, to avoid any possibility of overloading. The resistor R1012 and capacitor C1001 are provided to a.c. couple the op-amp and provide 100% d.c. negative feedback around it to minimize its output offset voltage.

The summing resistors R1001 through R1009 are chosen to provide specific matrixing coefficients, relative to the value of 27.4 kΩ which results in a coefficient of 1.000. These coefficient values are shown to the right of the respective resistors. The input terminals of the circuit are labeled with the signals they receive, either the LT, RT, —LT or —RT signals 3 from the input matrix 6 of FIG. 2, or the positive or negative polarity signals 19–29 from the six VCA circuits 18–28, labeled +LF, +RB etc. The signal labeled BF is obtained from the sum of signals LT and RT, passed through a three-pole low-pass filter (not shown) which is an optional feature of surround processors of this type discussed in an earlier Fosgate patent. The purpose of this filter is to cancel out the bass component of the signals presented to the surround processor so that the majority of the processing is performed essentially in the mid-frequency band.

The specific coefficients shown are 0.699 for LT, 0.294 for —RT, 0.113 for LF, 0.294 for +RB, 1.000 for BF, 0.393 for —FT, 0.699 for —LB, 1.000 for —BK and 0.374 for +LB when switch S1001 is enabled by the signal CORNER LOGIC KILL at terminal 116, which was discussed with reference to FIG. 6. Thus the signal equation for the output LFO at terminal 42, using the first set of VCA equations above for FIG. 9, is:

$$\begin{aligned} LFO = \ & 0.699\ LT - 0.294\ RT + \\ & 0.113\ k_{LF}\ (0.8676\ LT + 0.2875\ RT) + \\ & 0.294\ k_{RB}\ RT + BF - \\ & 0.393\ k_{FT}\ (0.5\ LT + 0.5\ RT) - 0.699\ k_{LB}\ LT - \\ & k_{BK}\ (0.5\ LT = 0.5\ RT) + 0.374\ \ CLK\ k_{LB}\ LT \end{aligned}$$

Although this equation may appear complicated, it illustrates how the cancellation is achieved, if one remembers that the k values vary between 0 and 1 with the corresponding control voltage signals, that no more than two at a time are non-zero, and that the total of all the k values does not exceed 1. Thus, for a pure LB signal, $k_{LB}$=1 and all the other k values are 0, so the LFO signal's 0.699 LT component is canceled out by the −0.699 $k_{LB}$ LT term. The −0.294 RT term is similarly canceled out by the 0.294 $k_{RB}$ RT term for a pure RB signal. When CORNER LOGIC KILL (CLK) is on, the LB cancellation term is reduced, since there is now a +0.374 $k_{LB}$ LT term introduced via the switch S1001. Thus the LT term in the LF output is not totally canceled but reduced from 0.699 to 0.325 or about 7 dB lower.

The RF matrix portion of matrix 30 is symmetrically identical to the LF matrix, i.e. with left and right signals interchanged. The BK term is in the opposite polarity. Resistors R1013 through R1022 again define the various coefficients, which are identical to those in the LF matrix, with S1002 operated by the CORNER LOGIC KILL signal (CLK) at terminal 116, which is duplicated here only to improve clarity and aid understanding. The RF buffer 34 is identical to the LF buffer 32 and comprises the op-amp U1002 with resistors R1023 and R1024, and capacitor C1002. Thus the RFO output signal at terminal 44 is represented by the equation:

$$\begin{aligned} RFO = \ & 0.699\ RT - 0.294\ LT + \\ & 0.113\ k_{RF}\ (0.8676\ RT + 0.2875\ LT) + \\ & 0.294\ k_{LB}\ LT + BF - \\ & 0.393\ k_{FT}\ (0.5\ LT + 0.5\ RT) - 0.699\ k_{RB}\ RT - \\ & k_{BK}\ (0.5\ LT = 0.5\ RT) + 0.374\ \ CLK\ k_{RB}\ RT \end{aligned}$$

Referring to FIG. 10*b*, the CF matrix portion of matrix 30 is similar, but simpler, comprising resistors R1025 through R1031 with their corresponding coefficients as shown to the right of each resistor. The CF buffer comprising op-amp U1003, capacitor C1003, and resistors R1032 and R1033 is again identical to those for LF and RF. The corresponding output equation for the signal CFO at terminal 46 is also simplified, since there is no switch in this circuit:

$$\begin{aligned} CFO = {} & 0.591\,LT + 0.591\,RT - 0.591\,k_{LB}\,LT - \\ & 0.591\,k_{RB}\,RT + 0.183\,k_{FT}\,(0.5\,LT + 0.5\,RT) - \\ & 0.715\,k_{LF}\,(0.8676\,LT + 0.2875\,RT) - \\ & 0.715\,k_{RF}\,(0.8676\,RT + 0.2875\,LT) \end{aligned}$$

The LB matrix portion of matrix 30 has nine resistors R1034 through R1042 defining the coefficients shown to their right, and the combined signal may also be switched via a delay circuit 138 in some modes of operation by means of switches S1003 and S1004 controlled by the DELAY IN/OUT signal applied to terminal 136. The LB buffer 38 comprises op-amp U1004 with resistors R1043 through R1045 and capacitors C1004 and C1005. It is essentially the same as the previously described buffers, with the exception that a shelf filter is created by the additional feedback components C1004 and R1043 shown. This has the effect of reducing the high frequency gain by about 5–6 dB which can be effective in reducing sibilant "splash" from center front dialog, especially in movie soundtracks. The equation for the output signal LBO appearing at terminal 48 is:

$$\begin{aligned} LBO = {} & 0.699\,LT - 0.499\,RT - \\ & 0.200\,k_{FT}\,(0.5\,LT + 0.5\,RT) - \\ & 0.226\,k_{BK}\,(0.5\,LT - 0.5\,RT) + 0.499\,k_{RB}\,RT + \\ & 0.137\,k_{LB}\,LT - \\ & 0.488\,k_{LF}\,(0.8676\,LT + 0.2875\,RT) + \\ & 0.206\,k_{RF}\,(0.8676\,RT + 0.2875\,LT) + 0.274\,BF \end{aligned}$$

The RB matrix circuit portion of matrix 30 is comprised of an identical set of resistors R1046 through R1054, also with a delay 140 switched in or bypassed by switches S1005 and S1006, switched by the DELAY IN/OUT signal at terminal 136, again duplicated for clarity. The same coefficients are used, but the left and right channels are swapped and the opposite polarity of the BK signal is used. The RB buffer 40 is identical to the LB buffer 38, comprising op-amp U1005, resistors R1055 through R1057 and capacitors C1006 through C1007. The equation for the RBO signal appearing at terminal 50 is:

$$\begin{aligned} RBO = {} & 0.699\,RT - 0.499\,LT - \\ & 0.200\,k_{FT}\,(0.5\,LT + 0.5\,RT) + \\ & 0.226\,k_{BK}\,(0.5\,LT - 0.5\,RT) + \\ & 0.499\,k_{LB}\,LT + 0.137\,k_{RB}\,RT - \\ & 0.488\,k_{RF}\,(0.8676\,RT + 0.2875\,LT) + \\ & 0.206\,k_{LF}\,(0.8676\,LT + 0.2875\,RT) + 0.274\,BF \end{aligned}$$

FIG. 11 shows a similar matrixing network suitable for use with the second mode of the detector splitter circuit of FIG. 6 and the alternative configuration of FIG. 9 discussed previously. The main differences between FIGS. 10 and 11 are the values of the matrixing resistors and corresponding matrixing coefficients.

Figure 11A:
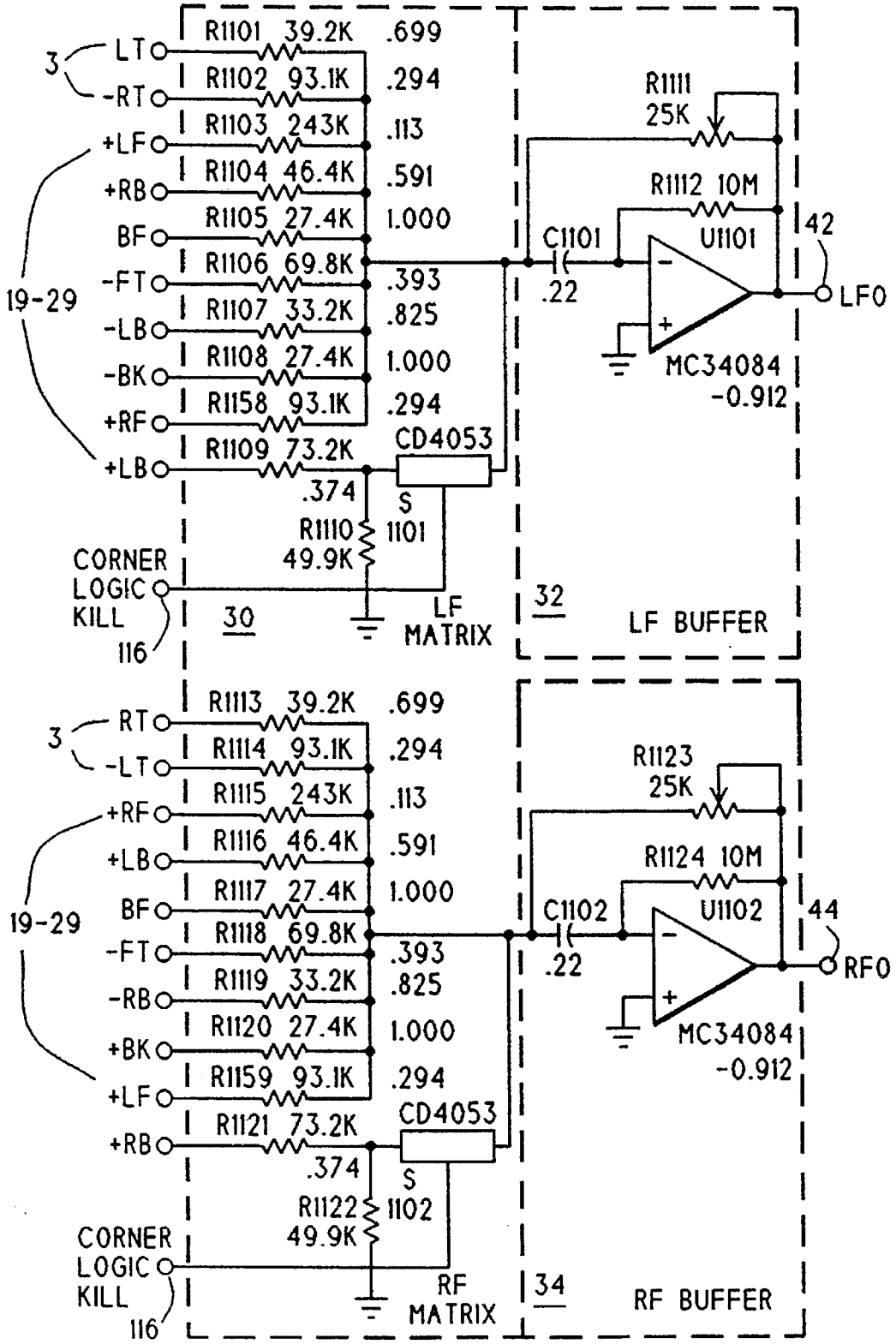
FIG. 11 is a block schematic of a second output matrix configuration according to the invention.
Figure 11B:
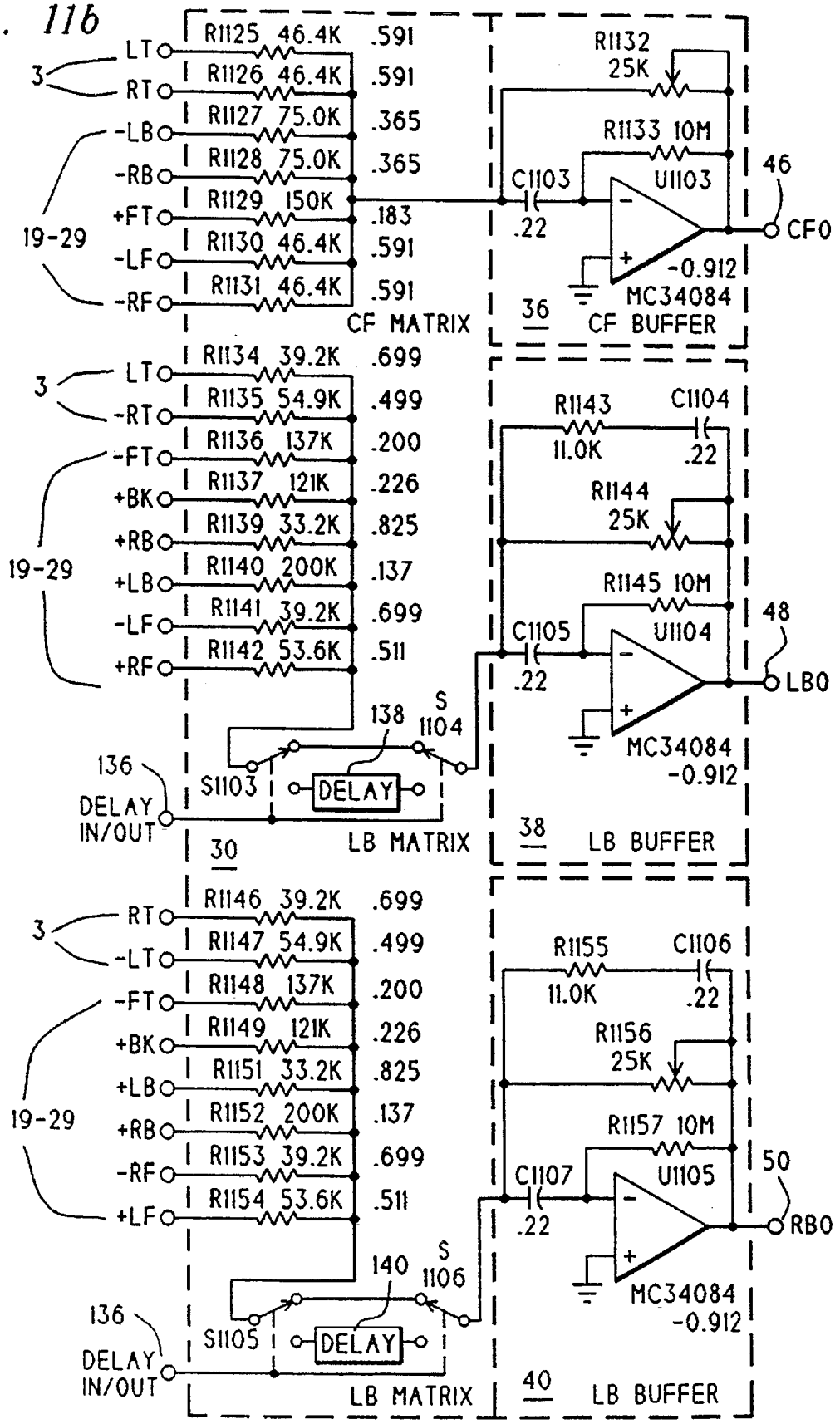

To simplify the discussion of FIGS. 11*a* and 11*b*, observe that corresponding resistors are numbered correspondingly to those in FIGS. 10*a* and 10*b*, as far as possible, except for being R11xx instead of R10xx. All of the buffer circuits are identical to those shown in FIGS. 10*a* and 10*b*, with the same nomenclature differences.

In FIG. 11*a*, one additional resistor R1158 appears in the LF matrix and a corresponding resistor R1159 appears in the RF matrix portion of matrix 30. These respectively apply canceling signals for the RT and LT antiphase components of the LF and RF matrix, this feature of antiphase blending having been disclosed in an earlier Fosgate patent application. With the coefficients shown to the right of the several resistors in the matrix 30, the equations for the outputs LFO and RFO appearing respectively at terminals 42 and 44 are, respectively, using the second set of equations for the alternative VCA configuration of FIG. 9 above:

$$\begin{aligned} LFO = {} & 0.699\,LT - 0.294\,RT + 0.113\,k_{LF}\,LT + \\ & 0.591\,k_{RB}\,(-0.2875\,LT + 0.8676\,RT) + BF - \\ & 0.393\,k_{FT}\,(0.5\,LT + 0.5\,RT) - \\ & 0.825\,k_{LB}\,(0.8676\,LT - 0.2875\,RT) - \\ & k_{BK}\,(0.5\,LT - 0.5\,RT) + 0.294\,k_{RF}\,RT + \\ & 0.374\,CLK\,k_{LB}\,(0.8676\,LT - 0.2875\,RT) \end{aligned}$$

$$\begin{aligned} RFO = {} & 0.699\,RT - 0.294\,LT + 0.113\,k_{RF}\,RT + \\ & 0.591\,k_{LB}\,(-0.8676\,LT - 0.2875\,RT) + BF - \\ & 0.393\,k_{FT}\,(0.5\,LT + 0.5\,RT) - \\ & 0.825\,k_{RB}\,(0.8676\,RT - 0.2875\,LT) + \\ & k_{BK}\,(0.5\,LT - 0.5\,RT) + 0.294\,k_{LF}\,LT + \\ & 0.374\,CLK\,k_{RB}\,(0.8676\,RT - 0.2875\,LT) \end{aligned}$$

Turning to FIG. 11*b*, this will be seen to be identical to FIG. 10*b* except that the components previously numbered 10xx are numbered correspondingly 11xx, and some resistors in the matrix portion 30 are absent or have different values. Again, the buffers 36, 38 and 40 are identical to those of FIG. 10*b*. In particular, the matrix 30 includes no resistors R1138 or R1150 corresponding with R1038 and R1050 respectively, and resistors R1127, R1128, R1130, R1131, R1139, R1141, R1142, R1151, R1153, and R1154 have different values from their counterparts in FIG. 10*b*. The corresponding equations for the signals CFO, LBO and RBO appearing at terminals 46, 48, and 50 respectively (again using the second set of equations for FIG. 9 VCA's) are:

$$\begin{aligned} CFO = {} & 0.591\,LT + 0.591\,RT - \\ & 0.365\,k_{LB}\,(0.8676\,LT - 0.2875\,RT) - \\ & 0.365\,k_{RB}\,(0.8676\,RT - 0.2875\,LT) + \\ & 0.183\,k_{FT}\,(0.5\,LT + 0.5\,RT) - \\ & 0.591\,k_{LF}\,LT = 0.591\,k_{RF}\,RT \end{aligned}$$

$$\begin{aligned} LBO = {} & 0.699\,LT + 0.499\,RT - \\ & 0.200\,k_{FT}\,(0.5\,LT + 0.5\,RT) - \\ & 0.226\,k_{BK}\,(0.5\,LT - 0.5\,RT) + \\ & 0.825\,k_{RB}\,(0.8676\,RT - 0.2875\,LT) + \\ & 0.137\,k_{LB}\,(0.8676\,LT - 0.2875\,RT) - \\ & 0.699\,k_{LF}\,LT + 0.511\,k_{RF}\,RT \end{aligned}$$

-continued $$RBO = 0.699\,RT + 0.499\,LT - 0.200\,k_{FT}(0.5\,LT + 0.5\,RT) + 0.226\,k_{BK}(0.5\,LT - 0.5\,RT) + 0.825\,k_{LB}(0.8676\,LT - 0.2875\,RT) + 0.137\,k_{RB}(0.8676\,RT - 0.2875\,LT) - 0.699\,k_{RF}\,RT + 0.511\,k_{LF}\,LT$$

To further explain the operation of these equations, the results may be tabulated for each of the principal sound source directions. In the table, the first two columns give the values of LT and RT, and the remaining columns represent the output signals, for each of the input directions listed at the left.

In the first mode of operation of FIG. 6, i.e. with switch S505 in the first position as shown, and with the VCA's in the first configuration of FIG. 9, and the matrix values according to FIG. 10*a* and FIG. 10*b*, Table 1 gives the loudspeaker output signals for each principal source signal direction. The BF term is ignored, since it is only effective at low frequencies and is not dependent on the logic action.

TABLE 1

Loudspeaker output signals vs. source direction, with values of FIG. 10 and FIG. 6 S505 in first position, ignoring the BF term.

| Src Ctrl Dir Sig | LT | RT | LBO | LFO | CFORFORBO |
|---|---|---|---|---|---|
| LB | $k_{LB}$ | 1.000 | 0.000 | 0.836 | 0.0000.0000.0000.000 |
| LF | $k_{LF}$ | 0.924 | 0.383 | 0.010 | 0.6360.1210.0040.005 |
| CF | $k_{FT}$ | 0.707 | 0.707 | 0.000 | 0.0080.9650.0080.000 |
| RF | $k_{RF}$ | 0.383 | 0.924 | −0.005 | −0.0040.1210.6360.010 |
| RB | $k_{RB}$ | 0.000 | 1.000 | 0.000 | 0.0000.0000.0000.836 |
| CB | $k_{BK}$ | 0.707 | −0.707 | 0.687 | −0.0050.0000.0050.687 |

Thus, relative to the −3 dB level expected from the matrix, we have overall levels for each direction of:

| | | | | | | | |
|---|---|---|---|---|---|---|---|
| LB | +1.45 dB | LF | −0.76 dB | CF | +2.70 dB | CB | +2.76 dB |

in the first mode of FIG. 6 (RB and RF are the same as LB and LF, respectively).

In the second mode of FIG. 6, with the second configuration of the VCA's of FIG. 9 and the matrix values of FIG. 11, we can compute a similar table:

TABLE 2

Loudspeaker output signals vs. source direction, with values of FIG. 11 and FIG. 6 S505 in second position, ignoring the BF term.

| Src Ctrl Dir Sig | LT | RT | LBO | LFO | CFORFORBO |
|---|---|---|---|---|---|
| LB | $k_{LB}$ | 0.924 | −0.383 | 0.962 | 0.0060.0000.0000.000 |
| LF | $k_{LF}$ | 1.000 | 0.000 | 0.000 | 0.8120.0000.0000.005 |
| CF | $k_{FT}$ | 0.707 | 0.707 | 0.000 | 0.0080.9650.0080.000 |
| RF | $k_{RF}$ | 0.000 | 1.000 | 0.012 | 0.0000.0000.8120.010 |
| RB | $k_{RB}$ | −0.383 | 0.924 | 0.023 | 0.0000.0000.0000.962 |
| CB | $k_{BK}$ | 0.707 | −0.707 | 0.687 | −0.0050.0000.0050.687 |

Thus, relative to the −3 dB level expected from the matrix, we have overall levels for each direction of:

| | | | | | | | |
|---|---|---|---|---|---|---|---|
| LB | +2.68 dB | LF | +1.20 dB | CF | +2.70 dB | CB | +2.76 dB |

in the second mode of FIG. 6.

While the equations given above represent the exact relationships between the signals in both preferred modes of operation here described, of course there may be many variations and modifications to the resistor values for broadening or narrowing the presentation, for adapting the system for an additional center back output, for provision of left and right side loudspeakers, for inclusion of special filtering modes for multi-band operation, or as related to proprietary sound reproduction systems such as Lucas Arts THX and Dolby Surround, as has been described in Fosgate's earlier patents and patent applications.

These and many other modifications will become apparent to those experienced in the art, without departing from the spirit of the present invention.

What is claimed is:

1. A surround sound processor for receiving left and right audio signals of a stereophonic source and for processing said left and right signals for presentation on a plurality of loudspeakers surrounding a listening area so as to produce an impression of discrete sound sources surrounding a listener therein, said processor comprising:

an input matrix circuit which receives said left and right audio signals from a pair of input terminals and comprises at least an inverting amplifier and a non-inverting amplifier of equal gain for each channel to provide said left and a detector filter which filters said left and right audio signals from said input matrix and provides left and right filtered signals;

a detector matrix circuit which receives and combines said left and right filtered signals to provide their sum and difference as additional front and back signals respectively;

a direction detector circuit which receives said left and right filtered signals and processes them to provide a left-right direction signal proportional to the logarithm of the ratio of the amplitude of said right filtered signal to that of said left filtered signal, up to a limiting voltage, and which also receives said front and back signals and processes them to provide a front-back direction signal proportional to the logarithm of the ratio of the amplitude of said back signal to said front signal, up to the same limiting voltage;

a detector splitter circuit which receives said left-right and front-back direction signals and processes them to provide one or more additional direction signals while modifying said left-right and front-back direction signals to maintain constancy of the sum of said left-right direction signal, said front-back direction signal, and said one or more additional direction signals said detector splitter circuit including a switching circuit for changing said left-right and front-back direction signals between a forward oriented configuration and a backward-oriented configuration;

a servologic circuit which receives said modified left-right and front-back direction signals and said one or more additional direction signals from said detector splitter circuit and filters each of them to provide a plurality of smoothly varying control voltage signals of the same polarity;

a plurality of voltage-controlled amplifiers equal in number to said plurality of said control voltage signals, each one of said control voltage signals being connected to control the gain of each said voltage-controlled amplifier, each of said plurality of voltage-controlled amplifiers receiving different proportions of said left or right audio signals or their inversions from said input matrix circuit, and summing the received signals with a variable gain dependent upon the corresponding one of said plurality of said control voltage signals applied thereto; and an output said matrix circuit comprising a plurality of matrix circuits equal in number to said plurality of loudspeakers, each said plurality of mature circuits receiving one or more of said left and right signals and their inversions from said input matrix circuit and one or more output signals from said plurality of voltage-controlled amplifiers, and combining them in suitable proportions to obtain a loudspeaker feed signal wherein unwanted directional components are canceled, each said loudspeaker feed signal for driving the corresponding one of said plurality of loudspeakers surrounding said listening area.

2. The processor of claim 1 wherein said detector splitter circuit provides said one or more additional direction signals from said front-back and said left-right direction signals, said plurality of voltage-controlled amplifiers is six, and the corresponding said plurality of said control voltage signals is also six.

3. The processor of claim 1 further comprising switching means in said detector splitter circuit for changing the configuration thereof either to a three-axis configuration wherein said detector splitter circuit provides said one or more additional direction signals, or to a two-axis configuration wherein said detector splitter circuit provides no said one or more additional direction signals but inverts said left-right and said front-back direction signals and provides them to different inputs of said servologic circuit.

* * * * *